US011208798B2

(12) United States Patent
Lipinski et al.

(10) Patent No.: US 11,208,798 B2
(45) Date of Patent: Dec. 28, 2021

(54) SYSTEM AND METHOD FOR TOUCHLESS ACTUATION OF A TOILET

(71) Applicant: KOHLER CO., Kohler, WI (US)

(72) Inventors: John Lipinski, Sheboygan, WI (US); Clayton Garrels, Sheboygan, WI (US); Timothy Waack, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 60 days.

(21) Appl. No.: 16/225,853

(22) Filed: Dec. 19, 2018

(65) Prior Publication Data

US 2019/0203453 A1 Jul. 4, 2019

Related U.S. Application Data

(60) Provisional application No. 62/613,299, filed on Jan. 3, 2018.

(51) Int. Cl.

| | |
|---|---|
| ***E03D 5/10*** | (2006.01) |
| ***E03D 5/092*** | (2006.01) |
| ***E03D 1/14*** | (2006.01) |

(52) U.S. Cl.

CPC ..... *E03D 5/105* (2013.01); *E03D 5/092* (2013.01); *E03D 1/142* (2013.01)

(58) Field of Classification Search

CPC ..... F21V 33/004; E03D 5/09; E03D 5/092; E03D 5/094; E03D 5/105; E03C 1/055; E03C 1/057

See application file for complete search history.

(56) References Cited

U.S. PATENT DOCUMENTS

| | | | | |
|---|---|---|---|---|
| 4,805,247 | A | 2/1989 | Laverty, Jr. | |
| 5,603,127 | A | 2/1997 | Veal | |
| 5,950,983 | A | 9/1999 | Jahrling | |
| 6,231,203 | B1 * | 5/2001 | Olshausen ..... | F21S 8/035 362/101 |
| 6,618,864 | B2 | 9/2003 | Veal | |
| 7,032,256 | B2 | 4/2006 | Contadini | |
| 7,140,050 | B2 | 11/2006 | Muderlak | |

(Continued)

FOREIGN PATENT DOCUMENTS

| | | |
|---|---|---|
| CA | 2557704 A | 2/2008 |
| CN | 201395837 Y | 2/2010 |

(Continued)

OTHER PUBLICATIONS

Extended European Search Report in EP Application No. 19150031.3 dated May 27, 2019.

(Continued)

*Primary Examiner* — Erin Deery

(74) *Attorney, Agent, or Firm* — Lempia Summerfield Katz LLC

(57) ABSTRACT

A trip lever assembly for a toilet includes a body and an infrared sensor. The body is configured to be mechanically coupled to a flush valve assembly of the toilet. The infrared sensor is coupled to the body, and is configured to be electrically coupled to the flush valve assembly. The body is configured to be manually actuated to control the flush valve assembly. The infrared sensor is a time-of-flight sensor configured to detect the distance of an object in a detection region of the infrared sensor to control the flush valve assembly.

20 Claims, 23 Drawing Sheets

(56) References Cited

U.S. PATENT DOCUMENTS

| | | | | |
|---|---|---|---|---|
| 7,322,054 | B2 * | 1/2008 | Bush | E03D 5/105 4/406 |
| 7,500,277 | B2 | 3/2009 | Bush | |
| 8,615,821 | B2 | 12/2013 | Funari | |
| 8,695,125 | B2 * | 4/2014 | Funari | E03D 5/105 4/406 |
| 9,000,377 | B2 | 4/2015 | Rossi et al. | |
| 9,428,897 | B2 | 8/2016 | Le et al. | |
| 9,657,471 | B2 | 5/2017 | Luettgen et al. | |
| 10,061,057 | B2 * | 8/2018 | Wong | G01V 8/12 |
| 10,808,921 | B2 * | 10/2020 | Heuer | F21V 33/004 |
| 2005/0076425 | A1 * | 4/2005 | Contadini | E03D 5/09 4/405 |
| 2006/0080765 | A1 * | 4/2006 | Olshausen | E03D 5/092 4/405 |
| 2006/0277674 | A1 | 12/2006 | Oakes | |
| 2008/0196151 | A1 * | 8/2008 | Oakes, Jr. | E03D 5/02 4/406 |
| 2009/0121171 | A1 | 5/2009 | Parsons et al. | |
| 2012/0246815 | A1 | 10/2012 | Lin et al. | |
| 2015/0268342 | A1 | 9/2015 | Iott et al. | |
| 2017/0051481 | A1 * | 2/2017 | Mercer | G01S 17/10 |
| 2017/0183853 | A1 | 6/2017 | Crist et al. | |
| 2019/0004207 | A1 | 1/2019 | Wong et al. | |
| 2019/0086890 | A1 | 3/2019 | Bradley et al. | |
| 2019/0203453 | A1 | 7/2019 | Lipinski et al. | |

FOREIGN PATENT DOCUMENTS

| | | | |
|---|---|---|---|
| CN | 107044158 | A | 8/2017 |
| CN | 210002509 | U | 1/2020 |
| EP | 1916345 | | 4/2008 |
| EP | 3 248 523 | A2 | 11/2017 |
| EP | 3 248 523 | A3 | 11/2017 |
| EP | 3508659 | A1 | 7/2019 |

OTHER PUBLICATIONS

Chinese Office Action for Chinese Patent Application No. 201910004321.1, dated Apr. 15, 2020.

* cited by examiner

SYSTEM AND METHOD FOR TOUCHLESS ACTUATION OF A TOILET

CROSS-REFERENCE TO RELATED APPLICATIONS

This application claims the benefit of and priority to U.S. Provisional Application No. 62/613,299, filed Jan. 3, 2018, the entire disclosure of which is hereby incorporated by reference herein.

BACKGROUND

The present application relates generally to the field of toilets. More specifically, the present application relates to a system and method for touchless actuation of a toilet.

Generally speaking, a toilet can include a flush valve disposed in a tank of the toilet for performing a flushing function. Some toilets include a trip lever located external to the tank for manually actuating the flush valve. Other toilets can include a sensor and a control system to allow for touchless actuation of the flush valve.

SUMMARY

One embodiment relates to a trip lever assembly for a toilet including a body and an infrared sensor. The body is configured to be mechanically coupled to a flush valve assembly of the toilet. The infrared sensor is coupled to the body, and is configured to be electrically coupled to the flush valve assembly. The body is configured to be manually actuated to control the flush valve assembly. The infrared sensor is a time-of-flight sensor configured to detect the distance of an object in a detection region of the infrared sensor to control the flush valve assembly.

Another embodiment relates to an actuator assembly for a toilet flush valve including a housing, a motor, a gear, a camshaft, and an actuator rod. The motor is disposed in the housing. The gear is coupled to an output shaft of the motor, and is configured to rotate about a first longitudinal axis. The camshaft is rotatably coupled to the housing, and is in rotational engagement with the gear. The camshaft is configured to rotate about a second longitudinal axis that is parallel to the first longitudinal axis. The actuator rod is coupled to the camshaft, and is configured to be coupled to the toilet flush valve and to translate in a longitudinal direction relative to the camshaft to control the toilet flush valve.

Yet another embodiment relates to an actuator assembly for a toilet flush valve including a housing, a gear, a camshaft, and an actuator rod. The gear is disposed in the housing and is configured to rotate about a first longitudinal axis. The camshaft is in rotational engagement with the gear, and is configured to rotate about a second longitudinal axis that is parallel to the first longitudinal axis. The actuator rod is engaged with the camshaft, and is configured to be coupled to the toilet flush valve and to translate in a longitudinal direction relative to the camshaft in response to rotational movement of the camshaft to control the toilet flush valve.

DETAILED DESCRIPTION

Referring generally to the FIGURES, disclosed herein is a toilet that includes a touchless or "hands-free" actuation system for performing a flushing function. According to an exemplary embodiment, the touchless actuation system includes a trip lever assembly located external to the tank that includes an integrated sensor. The sensor is electrically coupled to a processing circuit of a flush valve assembly located within the tank. The trip lever assembly is also coupled to the flush valve assembly by a mechanical linkage. In this way, the trip lever assembly can, advantageously, allow for either manual actuation of the trip lever assembly or touchless actuation of the sensor by a user to perform a flushing function. Furthermore, the particular type of sensor and its position in the trip lever assembly can help to reduce or eliminate issues relating to unintended flushes and can provide for improved sensor performance, as compared to other touchless systems.

The disclosed system further includes an actuator assembly that is electrically coupled to the processing circuit. The actuator assembly has an efficient design that is compact, easier to assemble, and is more reliable, as compared to conventional flush valve actuators. In addition, the system includes a battery pack that has a connector subassembly for electrically coupling the battery pack to the actuator assembly. The connector subassembly has a design that can, advantageously, provide a sealing and connector interface to minimize degradation in battery performance, as compared to other electronic systems. These and other advantageous features will become apparent to those reviewing the present disclosure and figures.

Figure 1:
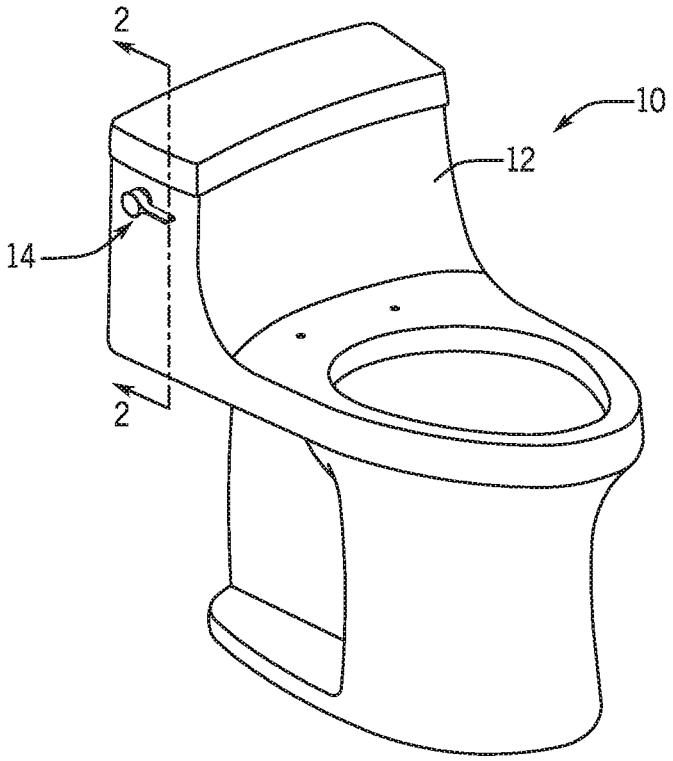
FIG. 1 is a perspective view of a plumbing fixture shown as a toilet, according to an exemplary embodiment.
Figure 2:
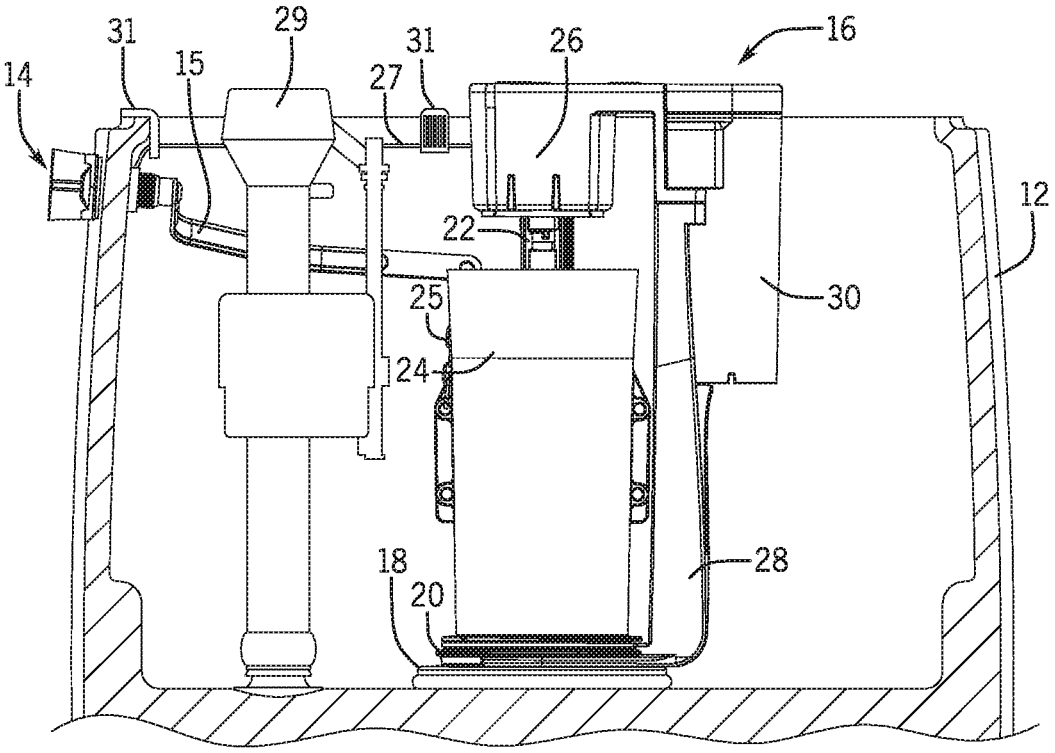
FIG. 2 is a partial cross-sectional view of a tank assembly of the toilet of FIG. 1.
Figure 3:
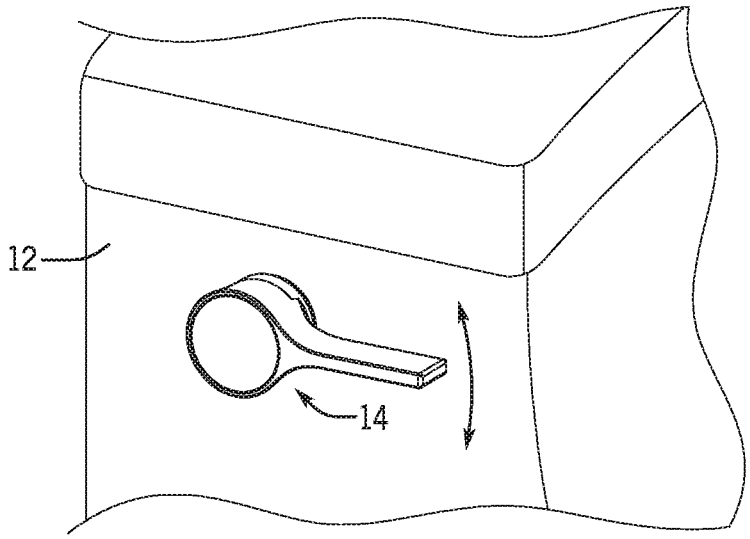
FIG. 3 is a partial perspective view of a trip lever assembly of the toilet of FIG. 1.

Referring to FIGS. 1-3, a plumbing fixture is illustrated as a toilet 10 according to an exemplary embodiment. In the exemplary embodiment of FIG. 1, the toilet 10 is a one-piece, gravity-flush toilet including an integrally formed tank 12. According to another exemplary embodiment, the toilet 10 is configured as a two-piece toilet including a separate tank. According to an alternative embodiment, the plumbing fixture is configured as a bidet.

As shown in FIGS. 1-3, the toilet 10 includes a trip lever assembly 14 pivotally coupled to a side of the tank 12. The trip lever assembly 14 is also electrically coupled to a flush valve assembly 16 disposed within the tank 12. According to the exemplary embodiment of FIG. 2, the trip lever assembly 14 is electrically coupled to a processing circuit of the flush valve assembly 16 by an electrical wire 27 (e.g., processing circuit 220 of FIG. 31), although the trip lever assembly 14 may be electrically coupled by other means, according to other exemplary embodiments (e.g., wireless technology, etc.). According to an exemplary embodiment, the electrical wire 27 is routed along an upper peripheral edge of the tank 12 by a plurality of clips 31. The trip lever assembly 14 is further coupled to a canister 24 of the flush valve assembly 16 by a linkage 15 and a chain 25. The trip lever assembly 14 is configured to be manually actuated by pivoting the lever relative to the tank 12 in a pivot plan parallel to a front face of the trip lever assembly as shown in FIG. 3, such that the linkage 15 and the chain 25 lift the canister 24 away from a valve base 20 of the flush valve assembly, so as to uncover a water outlet at the bottom of the tank 12 to enable flushing of the toilet 10. The trip lever assembly 14 is further configured to detect the distance of an object (e.g., a user's hand or forearm, etc.) within a detection region of the trip lever assembly, and to send a corresponding signal to the processing circuit of the flush valve assembly 16 to actuate the flush valve assembly (e.g., by lifting the canister 24). In this manner, the trip lever assembly 14 can, advantageously, allow for both manual and touchless actuation of a flushing function of a toilet, such as toilet 10.

Figure 4:
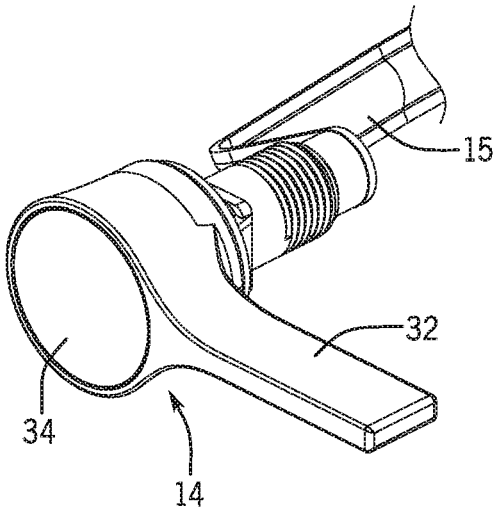
FIG. 4 is a partial perspective view of the trip lever assembly of FIG. 3.
Figure 6:
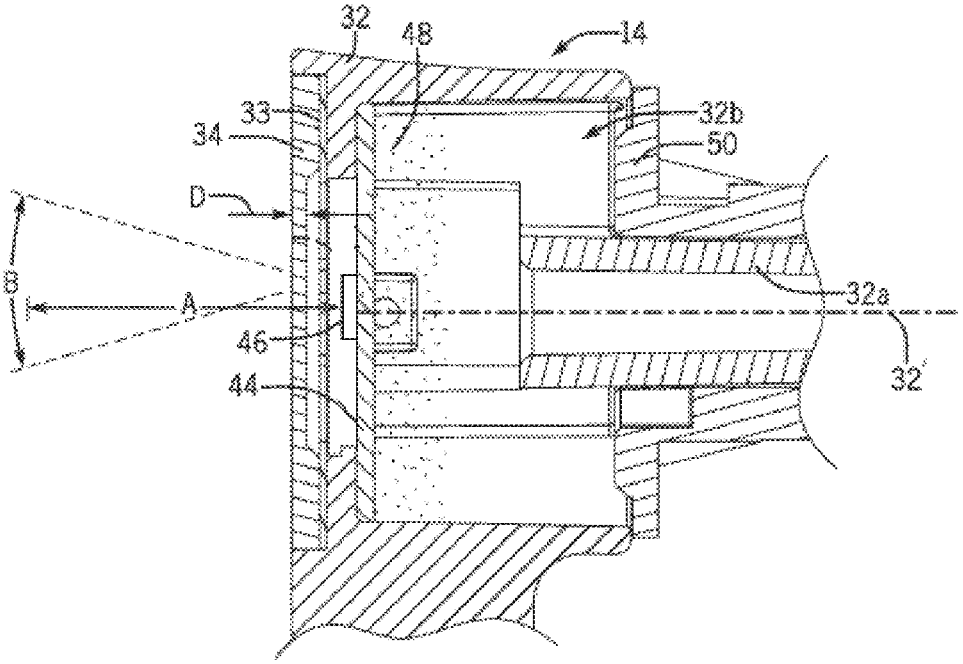
FIG. 6 is a partial cross-sectional view of the trip lever assembly of FIG. 4.
Figure 7:
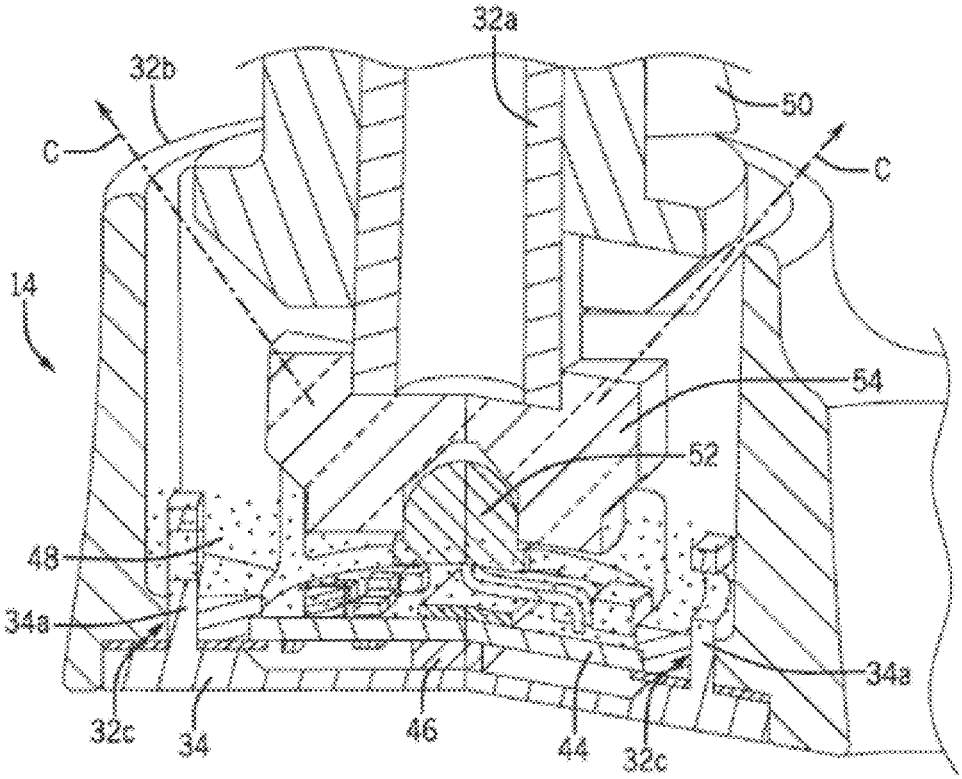
FIG. 7 is a partial cutaway view of the trip lever assembly of FIG. 4.

Referring to FIGS. 4 and 6-7, the trip lever assembly 14 includes a body 32 (e.g., lever, etc.) and a lens 34 (e.g., cover member, etc.) coupled to a front portion of the body 32. The lens 34 is generally planar and defines a front facing surface of the body 32. According to an exemplary embodiment, the lens 34 is made from a substantially opaque infrared (IR) transmissive material. The lens 34 includes a localized region having a uniform thickness "D" of about 1.0 mm to allow for IR signals from a sensor 46 disposed directly behind the localized region of the lens to pass therethrough. By having a lens with a uniform thickness of about 1.0 mm directly in front of the sensor 46, the trip lever assembly 14 can, advantageously, provide an IR detection region that reduces or eliminates issues relating to unintended flushes and can provide for improved sensor performance, as compared to conventional touchless systems.

For example, as shown in the embodiment of FIGS. 6-7, the trip lever assembly 14 includes an electronic circuit board 44 coupled within the body 32. The sensor 46 is coupled to a front surface of the circuit board 44 between the lens 34 and the circuit board 44. According to an exemplary embodiment, the sensor 46 is an IR "time-of-flight" sensor configured to detect the distance of an object in a detection region of the sensor and to send a corresponding signal to a processing circuit of the flush valve assembly 16 (e.g., processing circuit 220 of FIG. 31).

Conventional IR sensors rely on the intensity of the amount of IR light reflected back at them to determine the presence of an object. Applicant found that relying just on the amount of light for touchless actuation of a toilet is not a reliable method for detection, as lighter colored objects can reflect better on average than darker colored objects. Darker colored objects can reduce the range of the system, and can cause frustration with perceived unresponsiveness. In contrast, an IR time-of-flight sensor looks at the time it takes for IR light to travel to and return from an object in its line-of-sight. The color of an object does not significantly affect the functionality of an IR time-of-flight sensor, as compared to conventional IR sensors. Thus, Applicant determined that utilizing an IR time-of-flight sensor for touchless actuation of a toilet can, advantageously, reduce unintended flushes and improve system reliability.

Still referring to FIGS. 6-7, the sensor 46 has a detection region defined by a linear distance "A" of about 2.0" (inches) to about 6.0" (inches) from a rear surface of the circuit board 44, and an angular distance "B" of about 25° (degrees). According to an exemplary embodiment, the detection region of the sensor 46 is tunable, such that a user or an installer can change the detection region based on a particular application (e.g., location of the toilet in a bathroom, user preferences, etc.). For example, the sensor may be tuned to have a detection region with a linear detection distance of 2" (inches), 4" (inches), or 6" (inches), according to an exemplary embodiment. The detection region may be tuned by a user or an installer via the processing circuit of the flush valve assembly 16 (e.g., processing circuit 220 of FIG. 31), the details of which are discussed in the paragraphs that follow. According to an exemplary embodiment, the sensor 46 may be enabled or disabled by the processing circuit, so as to, for example, allow for cleaning of the trip lever assembly 14 or to conserve battery energy.

Still referring to FIGS. 6-7, a seal 33 is disposed between the lens 34 and the circuit board 44. According to an exemplary embodiment, the seal 33 includes an adhesive portion for coupling the seal 33 to a portion of the body 32 and/or to couple the lens 34 to the body 32. As shown in FIG. 7, the lens 34 includes one or more tabs 34*a* that are inserted through openings 32*c* disposed in the body 32 to couple the lens to the body. A potting material 48 is applied in a rear cavity 32*b* of the body 32 to couple the circuit board 44 and the lens 34 to the body 32. The potting material 48 can flow around the one or more tabs 34*a* of the lens 34 and a rear portion of the circuit board 44 in the rear cavity 32*b* to couple the lens and the circuit board to the body 32. As shown in FIGS. 6-7, the lens 34 is recessed within the body 32, such that the outer facing surface of the lens 34 is substantially flush with the surrounding portion of the body 32. In this way, the lens 34 is unobstructed by other portions of the body 32, so as to provide a substantially clear line-of-sight for the sensor 46.

Referring to FIG. 7, the trip lever assembly 14 further includes a light source 52 coupled to a rear surface of the circuit board 44. According to an exemplary embodiment, the light source 52 is an LED. According to other exemplary embodiments, the light source 52 is an incandescent bulb or another type of light source. A light guide 54 is coupled to the body 32 in the cavity 32*b*, and surrounds at least a portion of the light source 52. The light guide 54 is configured to direct light emitted from the light source 52 in a rearward direction indicated generally by arrows "C" through the cavity 32*b* to illuminate a rear portion of the trip lever assembly 14 (i.e., behind the trip lever assembly 14 adjacent the tank 12). According to an exemplary embodiment, the light source 52 is a multi-colored LED configured to emit different colored light based on a current state or status of the touchless system.

For example, the light source 52 can emit a first colored light (e.g., blue, etc.) to indicate to a user that the system is ready to be flushed. According to an exemplary embodiment, the first colored light is emitted as a gradual pulse to provide further indication to a user. The light source 52 can also emit a second colored light (e.g., amber, etc.) to indicate a low battery to a user. According to an exemplary embodiment, the second colored light is emitted as a series of pulses followed by emission of the first colored light (e.g., three amber colored pulses followed by one blue colored pulse, etc.). The light source 52 can also emit a third colored light (e.g., red, etc.) to indicate an error to a user, such as an abnormal actuation or a communication error with the sensor 46. According to an exemplary embodiment, the third colored light is emitted as a sharp high/low intensity light pulse. In this way, the light source 52 and the light guide 54 can provide a visual indication of the status of the touchless system to a user (e.g., so that the user can decide what action to take, such as to use the manual actuator instead of the touchless actuator, etc.). According to another exemplary embodiment, the trip lever assembly 14 includes a plurality of light sources configured to provide the different colored indications. It should be appreciated that the light source 52 can provide a variety of different combinations of light colors, light intensities, and light pulses to provide different indications to a user, according to other exemplary embodiments.

Figure 8:
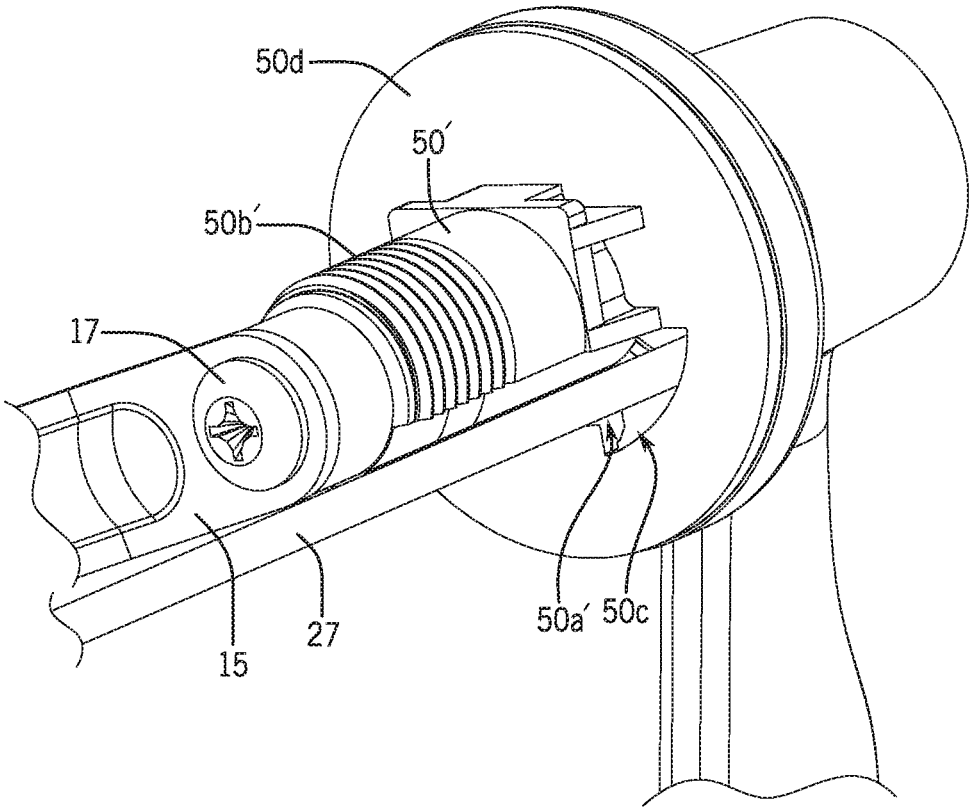
FIG. 8 is a partial rear perspective view of a trip lever assembly including a bushing according to another exemplary embodiment.

As shown in FIGS. 6-8 and 10, the body 32 further includes a stem 32*a* extending in a rearward direction away from the front facing surface of the body to define the rotational axis 32.' A bushing 50 is rotatably coupled to the stem 32*a*. The bushing 50 can be received through an opening 12*b* disposed in a sidewall of the tank 12, and can permit relative rotational movement between the body 32 (including sensor 46) and the tank 12 about the rotational axis 32' such that the sensor 46 is in alignment with the rotational axis 32' and coaxial with the rotation axis 32' as illustrated in FIG. 6. The bushing 50 includes a threaded portion 50*a* for threadably receiving a nut 56 to removably couple the trip lever assembly 14 to the tank 12. A spacer 58 is slidably disposed on the bushing 50 between a rear portion of the tank 12 and the nut 56. The spacer 58 includes a notch 58*a* (e.g., opening, slot, etc.) for receiving a portion of the electrical wire 27 therethrough, such that the electrical wire 27 can pass through the opening 12*b* of the tank 12. In addition, as shown in FIG. 8, the bushing 50 includes a slot 50*a* (e.g., void area, channel, etc.) for receiving a portion of the electrical wire 27 therein for routing the wire into the tank 12. In this manner, the bushing 50 and the spacer 58 can allow for the electrical wire 27 to pass through the opening 12*b* without damaging or compressing the wire against the tank 12.

According to another exemplary embodiment shown in FIG. 8, the trip lever assembly can include a bushing 50' having an integrated light guide portion 50*d*, instead of having a separate light guide coupled within the body 32 of the trip lever assembly (e.g., light guide 54). For example, as shown in FIG. 8, the bushing 50' includes a threaded portion 50*b'* for threadably receiving a nut to couple the trip lever assembly to a toilet (e.g., nut 56 of FIG. 10). The bushing 50' further includes an integrated light guide portion 50*d* that substantially surrounds the rear cavity of the body, such that light emitted by the light source 52 is directed/distributed by the light guide portion 50*d* of the bushing. The light guide portion 50*d* includes an opening 50*c* for routing the electrical wire 27 therethrough. The bushing 50' also includes a slot 50*a'* located adjacent to the opening 50*c* for receiving the electrical wire 27 therein to route the electrical wire through a wall of the tank 12. According to an exemplary embodiment, at least a portion of the light guide portion 50*d* is made from a transmissive material that can allow a substantial amount of light emitted by the light source 52 to pass therethrough so as to, for example, provide a visual indication to a user. According to an exemplary embodiment, the entire bushing 50' is made from a transmissive material. It should be appreciated that the bushing 50' may be used instead of the bushing 50 discussed above in the trip lever assembly 14 or trip lever assembly 36 discussed in the paragraphs that follow.

Figure 5:
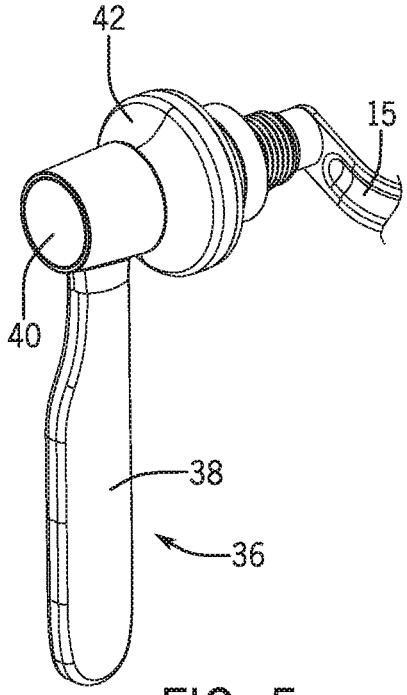
FIG. 5 is a partial perspective view of a trip lever assembly for use in the toilet of FIG. 1, according to another exemplary embodiment.
Figure 9:
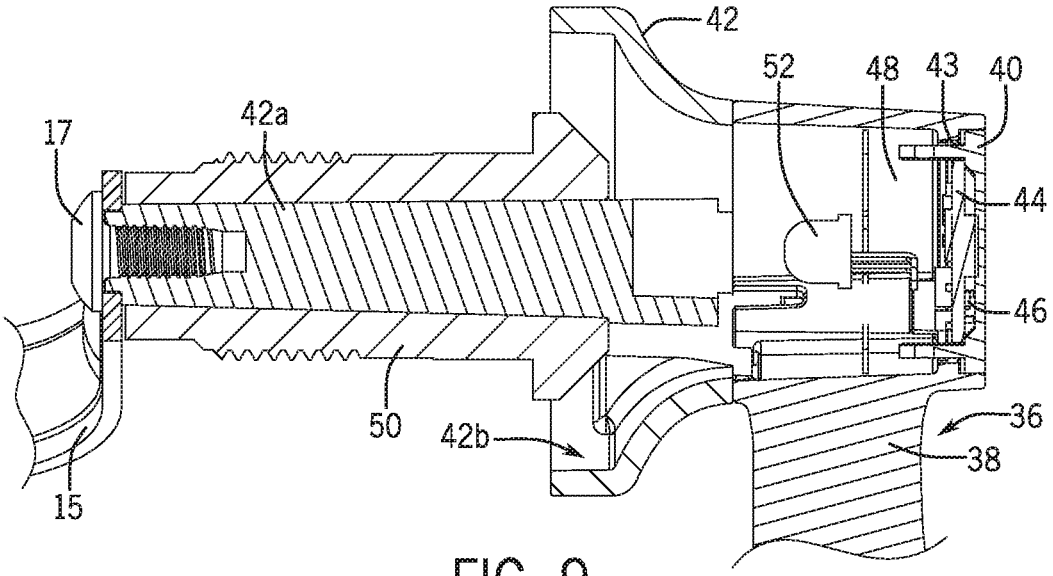
FIG. 9 is a cross-sectional view of the trip lever assembly of FIG. 5.
Figure 10:
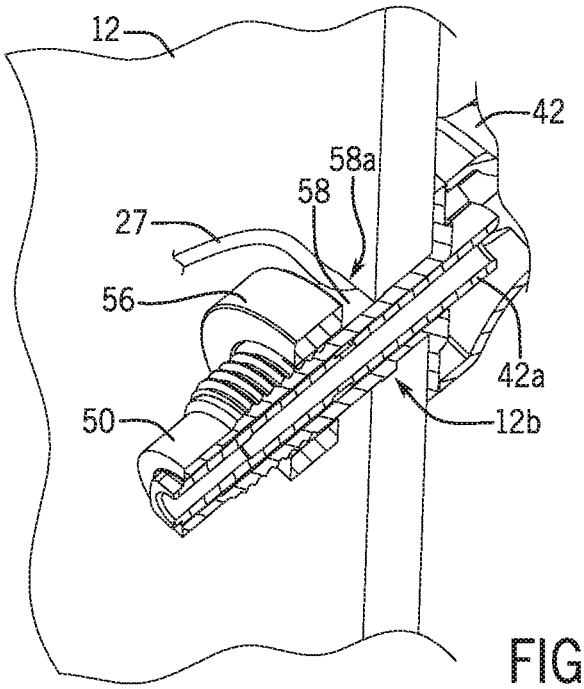
FIG. 10 is a partial cross-sectional view of the trip lever assembly of FIG. 5 shown coupled to the toilet of FIG. 1, according to an exemplary embodiment.

Referring to FIGS. 5 and 9, a trip lever assembly 36 is shown according to another exemplary embodiment. The trip lever assembly 36 is similar to the trip lever assembly 14 described above, but has a different style body 38 including an escutcheon 42 to provide a different aesthetic for the toilet 10. The details regarding the body 32, the circuit board 44, the sensor 46, the lens 34, the seal 33, the potting material 48, the stem 32*a*, and the bushing 50, 50' provided above are applicable to the corresponding elements of the trip lever assembly 36 discussed below. Accordingly, these details have been omitted from the description of the various elements of the trip lever assembly 36 for the sake of efficiency.

As shown in FIGS. 5 and 9, the trip lever assembly 36 includes a body 38 and an escutcheon 42 coupled to, or integrally formed with, a rear portion of the body. A lens 40 is coupled to a front portion of the body 38 and defines a front facing surface of the body. A circuit board 44 is coupled behind the lens 40, and includes the sensor 46 coupled to a front surface of the circuit board directly behind the lens 40. The circuit board 44 further includes the light source 52 coupled to a rear surface of the circuit board. A seal 43 is disposed between the lens 40 and the circuit board 44. A potting material 48 is disposed within an interior cavity of the body 38. The escutcheon 42 includes a stem 42*a* extending in a rearward direction away from the body 38. The linkage 15 is coupled to the stem 42*a* by a fastener 17 shown as a screw, according to an exemplary embodiment. The bushing 50 is rotatably coupled to the stem 42*a*. The escutcheon 42 defines an interior cavity 42*b* for routing a portion of an electrical wire therethrough, such as electrical wire 27 shown in FIG. 8. Similar to the trip lever assembly 14 described above, the trip lever assembly 36 can, advantageously, function as both a manual actuator and a touchless electronic actuator for performing a flushing function of a toilet, such as toilet 10.

Figure 11:
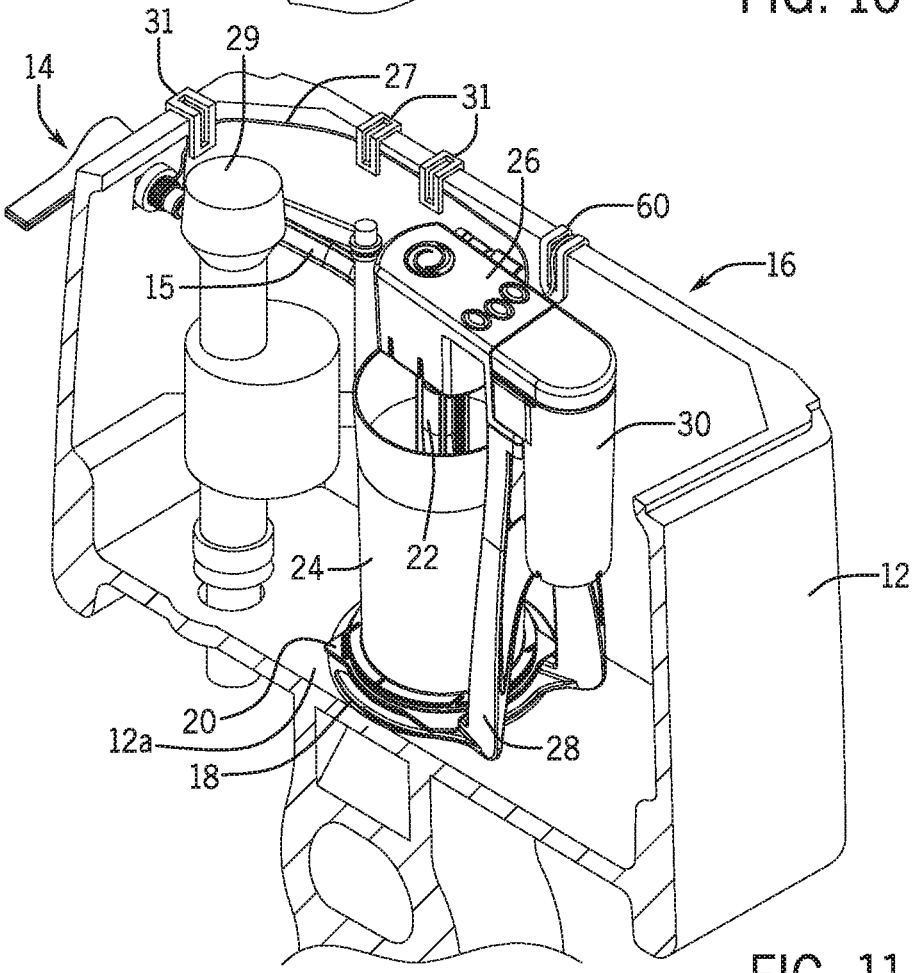
FIG. 11 is a partial cross-sectional view of a tank assembly of the toilet of FIG. 1.
Figure 12:
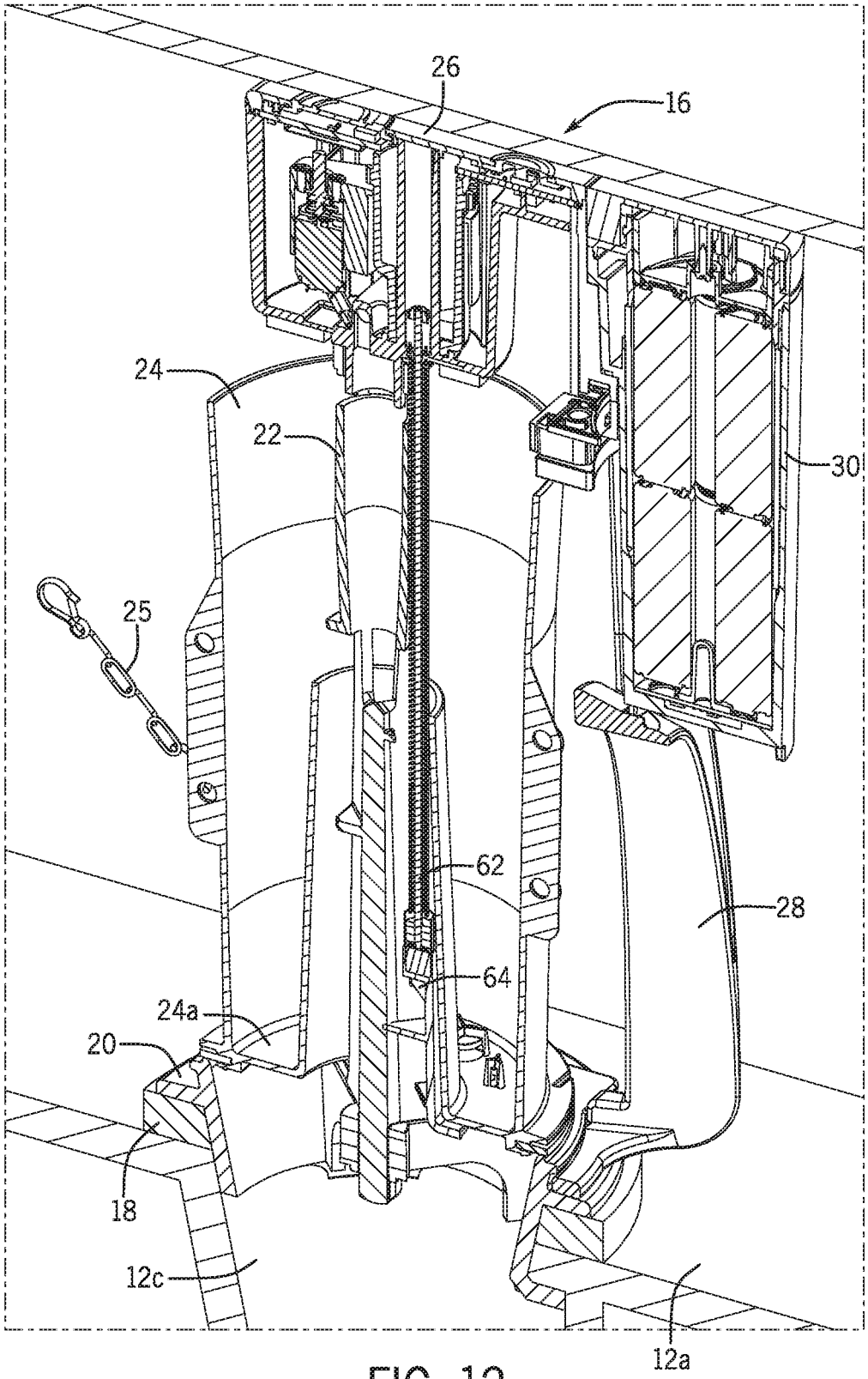
FIG. 12 is a partial cross-sectional view of the tank assembly of FIG. 11.
Figure 13:
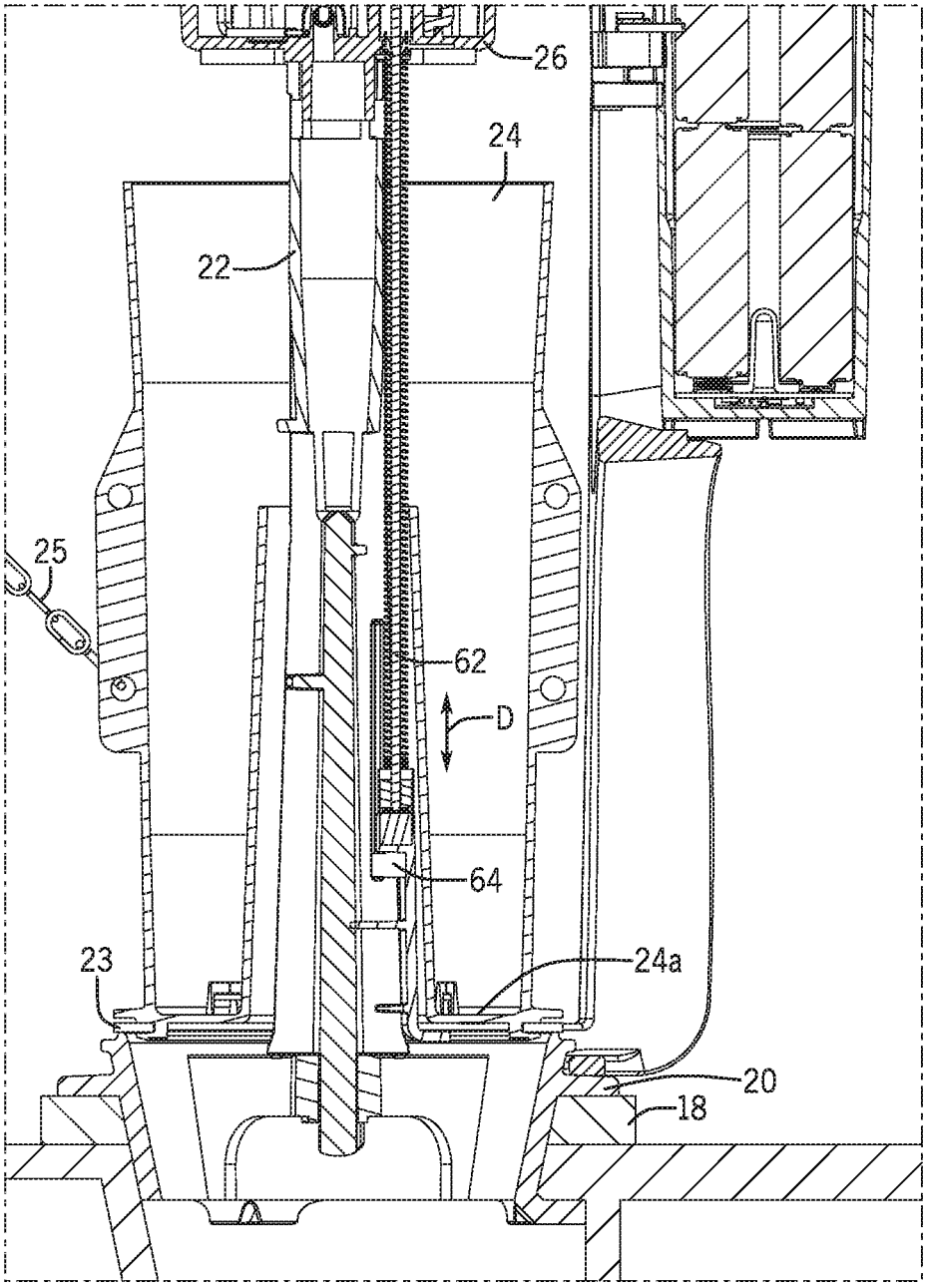
FIG. 13 is a detail view of a flush valve of the tank assembly of FIG. 12.

Referring now to FIG. 11, the interior of the tank 12 is shown according to an exemplary embodiment. As shown in FIG. 11, a flush valve assembly 16 is coupled within the tank 12. The flush valve assembly 16 includes a valve base 20 and a seal 18 coupled at a water outlet in the bottom wall 12*a* of the tank 12. The seal 18 is configured to sealingly engage the tank 12 along the bottom wall 12*a*, so as to prevent water from leaking between the seal 18 and the water outlet of the tank. The flush valve assembly 16 further includes a valve guide 22 coupled to a central portion of the valve base 20. The valve guide 22 is an elongated member and is oriented in a substantially vertical direction relative to the bottom wall 12*a*. The flush valve assembly 16 further includes a canister 24 disposed around the valve guide 22. The canister 24 is configured to sealingly engage the valve base 20 along a bottom portion 24*a* of the canister 24 via a canister seal 23, so as to prevent water from leaking between the canister 24 and the valve base 20 through the water outlet. The canister 24 is further configured to be moved in a vertical direction relative to the valve base 20, so as to selectively permit a flow of water from the tank 12 to pass through the water outlet to perform a flushing function, the details of which are discussed in the paragraphs that follow.

Still referring to FIG. 11, the flush valve assembly 16 further includes an actuator assembly 26 coupled to an upper portion of the valve guide 22. Support legs 28 are coupled between the valve base 20 and the actuator assembly 26 to provide additional support for the actuator assembly 26. A power supply 30 shown as a battery pack is removably coupled to the actuator assembly 26, and is configured to power the actuator assembly 26. The tank 12 also includes a fill valve 29 coupled therein and a nightlight 60 coupled to an upper edge of the tank. The actuator assembly 26 is configured to automatically lift the canister 24 away from the valve base 20 to perform a flushing function. According to an exemplary embodiment, the actuator assembly 26 includes a processing circuit 220 for controlling the actuator assembly 26, the details of which are discussed with respect to FIG. 31 below.

Figure 14:
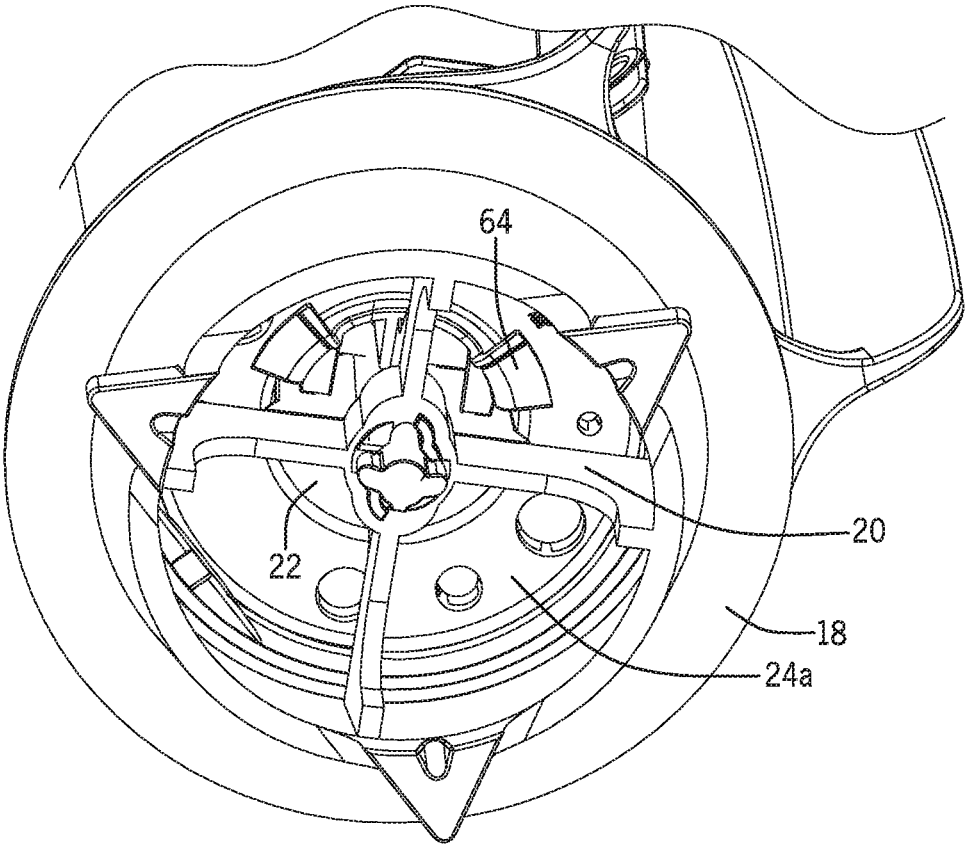
FIG. 14 is a bottom partial perspective view of the flush valve of FIGS. 12-13.
Figure 16:
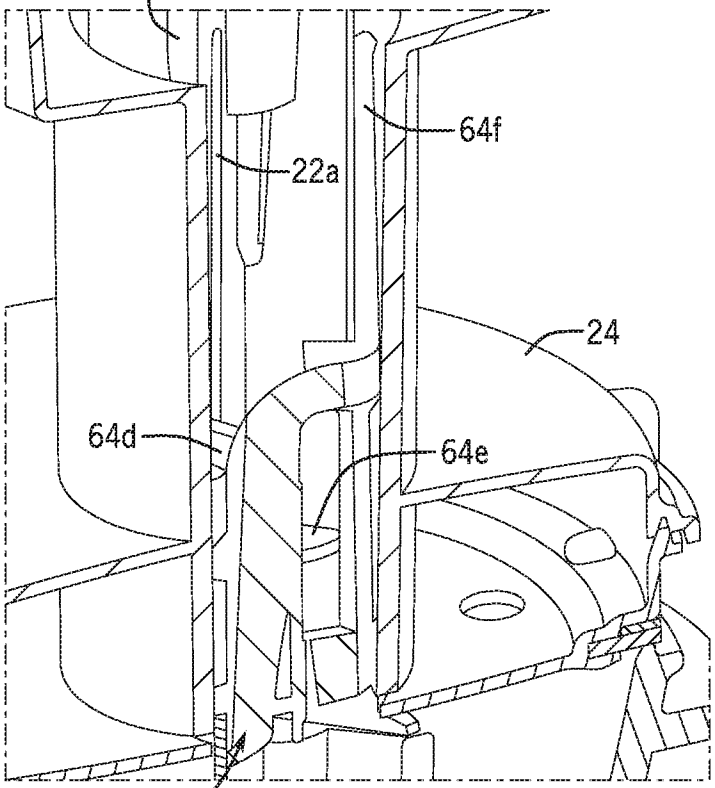
FIG. 16 is another partial perspective view of the actuator of the flush valve of FIGS. 12-13.
Figure 15:
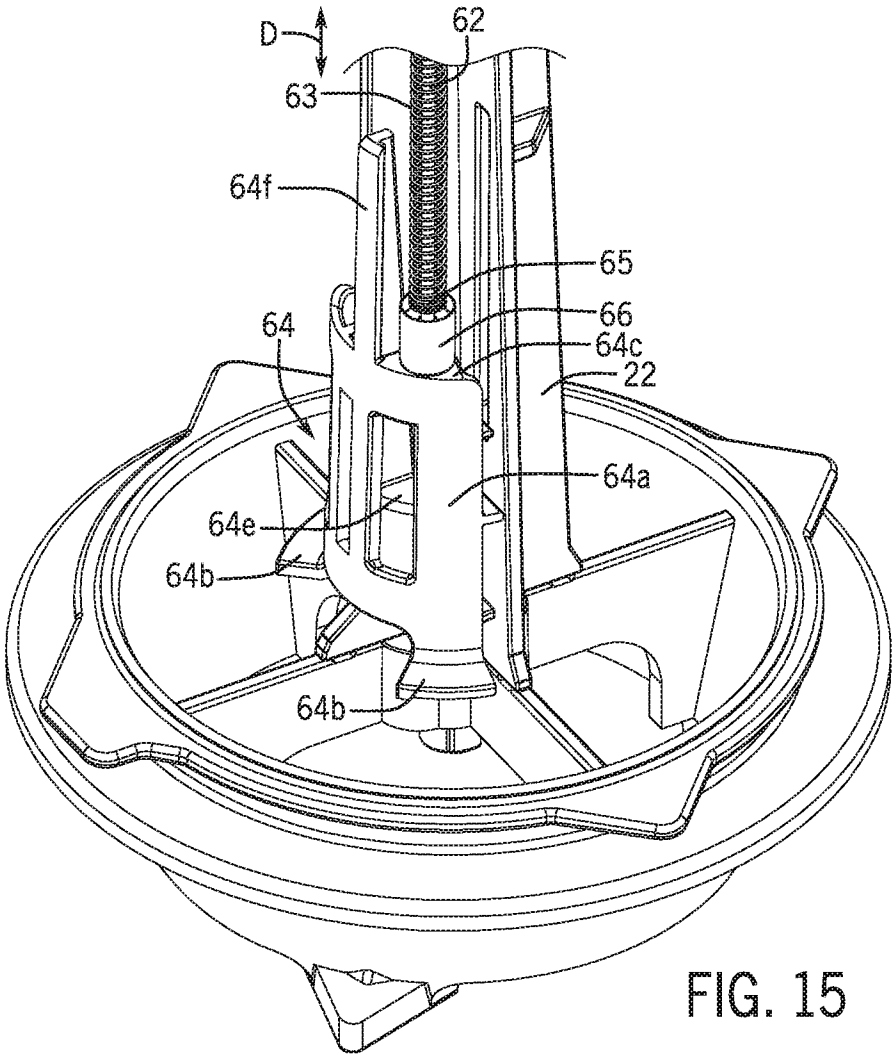
FIG. 15 is a partial perspective view of an actuator of the flush valve of FIGS. 12-13.

Referring to FIGS. 12-16, the flush valve assembly 16 includes an arm 64 slidably coupled to the valve guide 22. The arm 64 is further engaged with a bottom portion 24*a* of the canister 24 through a central opening of the canister (i.e., the center of the flush valve assembly 16). The arm 64 is configured to be lifted by an actuator rod 62 of the actuator assembly 26 in a vertical direction indicated generally by arrow "D" in FIG. 13, to thereby lift the canister 24 away from the valve base 20 to enable flushing of the toilet 10. As shown in FIGS. 14-15, the arm 64 includes one or more fingers 64*b* (e.g., flanges, etc.) extending outwardly away from a lower portion of the arm. The fingers 64*b* are configured to be positioned below, and to engage, the bottom portion 24*a* of the canister 24. The arm 64 further includes one or more tabs 64*d* (e.g., projections, guides, etc.) that are slidably disposed in respective vertical slots 22*a* of the valve guide 22. The tabs 64*d* include a flange portion to help retain the tabs 64*d* in the slots 22*a*. The arm 64 further includes one or more flanges 64*e* extending therefrom. The flanges 64*e* can provide structural rigidity and can surround a portion of the valve guide member 22 to act as a guide for the arm 64 during vertical movement of the arm 64. Likewise, the slots 22*a* can, advantageously, guide the tabs 64*d* to facilitate vertical movement of the arm 64 and the canister 24 relative to the valve guide 22. The arm 64 further includes an extension 64*f* extending in a longitudinal direction away from an upper portion 64*c* of the arm. The extension 64*f* can, advantageously, help to prevent the canister 24 from getting caught or stuck on top of the arm 64.

Figure 23:
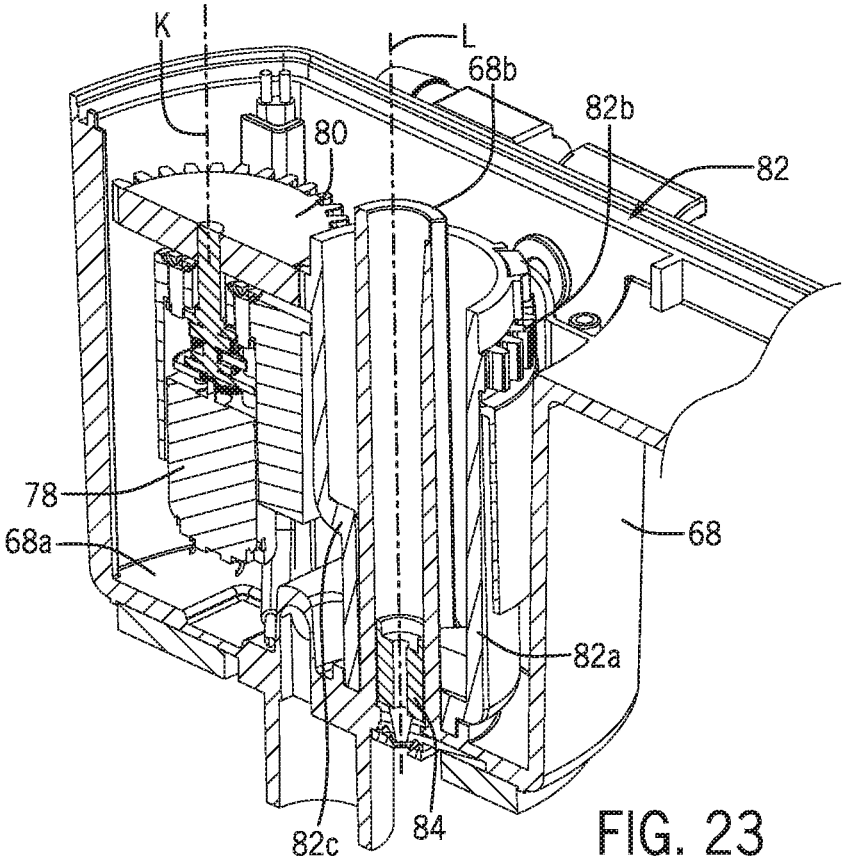
FIG. 23 is a partial cross-sectional view of an actuator assembly of the flush valve assembly of FIG. 17.

Still referring to FIGS. 12-16, the arm 64 further includes a first magnetic member 66 coupled to an upper portion 64*c* of the arm. The actuator rod 62 of the actuator assembly 26 includes a second magnetic member 65 coupled to a distal end of the rod. The second magnetic member 65 can be magnetically coupled to the first magnetic member 66, so as to automatically couple the actuator rod 62 to the arm 64 during installation of the flush valve assembly 16 (see FIG. 32 and associated description). In addition, if the canister 24 were to become stuck during a flushing operation (i.e., during lifting of the canister 24 via the actuator rod 62), the magnetic coupling force between the second magnetic member 65 and the first magnetic member 66 can be overcome by the motor (e.g., motor 78 in FIGS. 19 and 23, etc.) that lifts the actuator rod 62, so as to decouple the actuator rod 62 from the arm 64 and help to prevent damage to the assembly. The actuator rod 62 further includes a spring 63 disposed around a substantial portion of the actuator rod 62. The spring 63 is configured to bias or return the arm 64 to a starting position (i.e., a ready to flush position), shown in FIG. 12, after the arm 64 is lifted to perform a flushing function, the details of which are discussed in the paragraphs that follow.

Referring to FIGS. 17-19 and 32, the actuator assembly 26 includes a housing 68 and a user interface 70 coupled to an upper portion of the housing. A power source 30 shown as a battery pack is removably coupled to the housing 68. The actuator assembly 26 is coupled to an upper portion of the valve guide 22, such that the valve guide 22 and canister 24 are located directly below the actuator assembly. According to an exemplary embodiment, the actuator assembly 26 is removably coupled to the valve guide 22 via a twist-and-lock interface. A damper 76 is positioned between the valve guide 22 and the actuator assembly 26 to dampen or absorb impact from the valve guide 22 when the actuator assembly 26 is coupled thereto. In this way, the damper 76 can help to prevent damage to both the valve guide 22 and the housing 68 from, for example, repeated abrupt shocks during actuation of a flushing function. In addition, the damper 76 can dampen the shock carried to the base of the valve guide 22 near the valve base 20. According to an exemplary embodiment, the damper 76 is made from a closed cell foam material, and is coupled to a lower portion of the housing 68.

Figure 17:
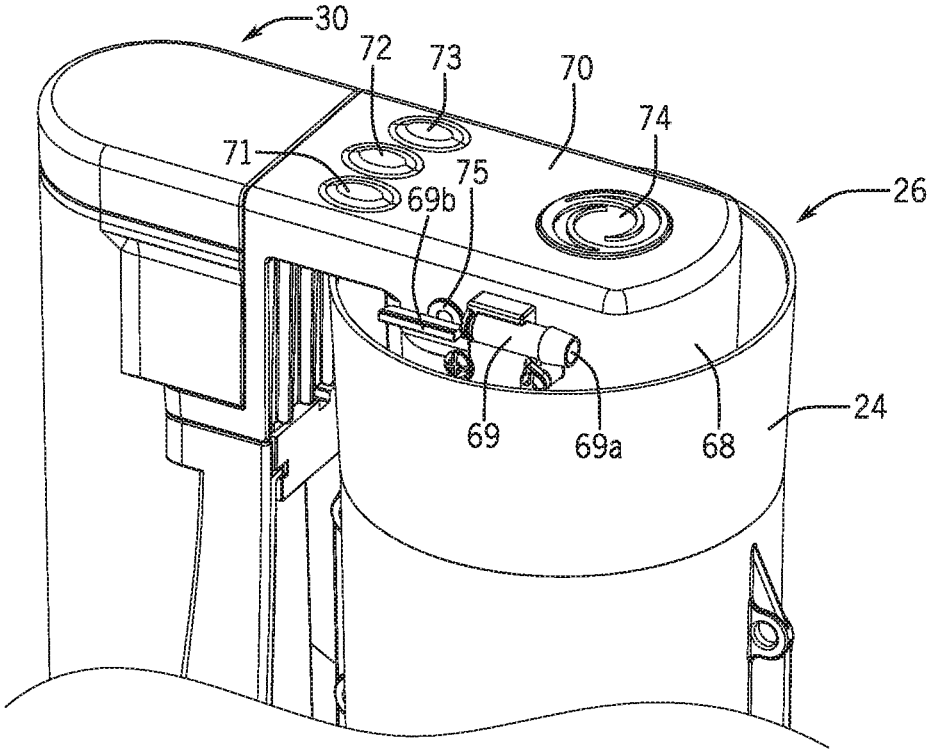
FIG. 17 is a partial perspective view of a flush valve assembly of the toilet of FIG. 1.
Figure 19:
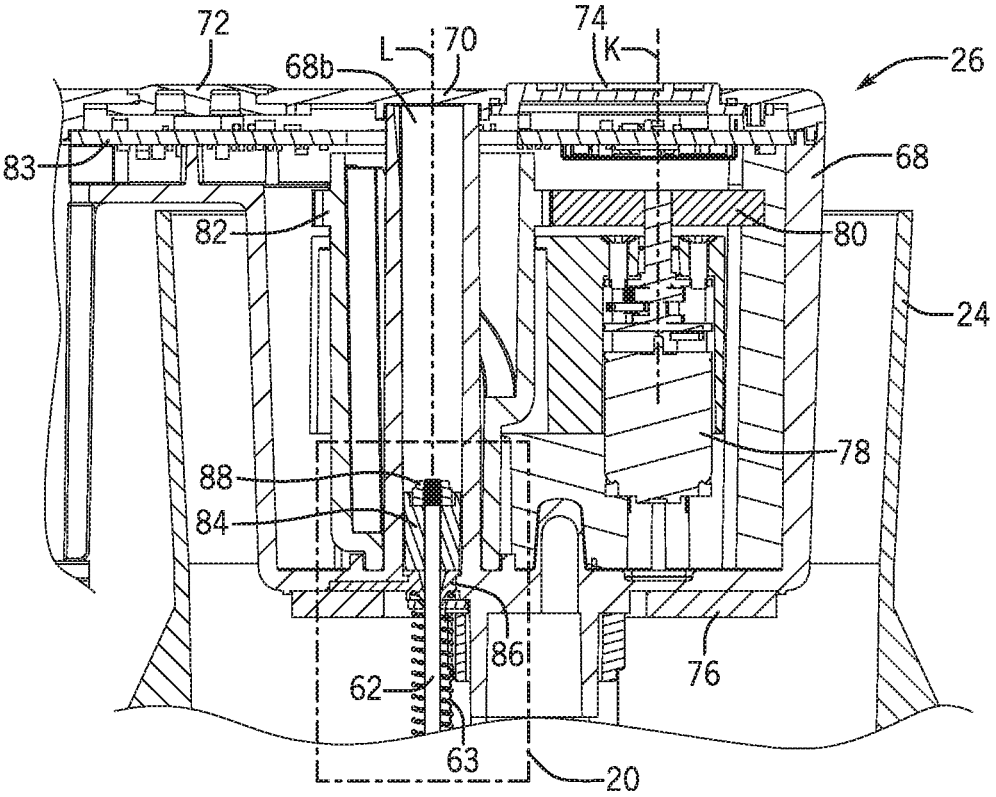
FIG. 19 is a partial cross-sectional view of the flush valve assembly of FIGS. 17-18.

As shown in FIG. 17, the user interface 70 includes a plurality of buttons 71, 72, 73 and an indicator 74. The user interface 70 is disposed on an uppermost portion of the actuator assembly 26, such that the plurality of buttons 71, 72, 73 and the indicator are accessible/visible to a user from above the tank 12 (i.e., when the lid is removed from the tank). The plurality of buttons 71, 72, 73 and the indicator 74 are in electrical communication with a processing circuit of the actuator assembly 26. For example, as shown in FIG. 19, the actuator assembly 26 includes a circuit board 83 disposed within the housing 68 below the user interface 70. The circuit board 83 includes a processing circuit 220 having a processor 222 and memory 224. Each of the plurality of buttons 71, 72, 73 and the indicator 74 is in electrical communication with the processing circuit 220.

According to an exemplary embodiment, a first button 71 is associated with wireless pairing of a mobile device with the touchless actuation system (e.g., via a Bluetooth communication protocol, etc.). A second button 72 is associated with tuning or adjusting the detection region of the sensor 46 of the trip lever assembly 14 (e.g., selecting a 2", 4", or 6" linear detection distance, etc.). A third button 73 is associated with controlling the nightlight 60 of the toilet 10 (e.g., controlling on/off functionality, controlling nightlight color/intensity, setting up a recurring illumination schedule, etc.). The indicator 74 can provide a visual indication of a status or mode of the system, such as, for example, to indicate that a mobile device has been paired with the touchless actuation system or that the system is in a pairing mode. According to other exemplary embodiments, the plurality of buttons 71, 72, 73 and the indicator 74 can provide other system controls or indications, such as flushing control, sensor override, system diagnostics, user data collection (e.g., number of flushes per day/week/month/year, etc.), and software updates.

According to various exemplary embodiments, the processor 222 can be implemented as a general purpose processor, an application specific integrated circuit (ASIC), one or more field programmable gate arrays (FPGAs), a group of processing components, or other suitable electronic processing components. The memory 224 (e.g., memory, memory unit, storage device, etc.) may include one or more devices (e.g., RAM, ROM, Flash memory, hard disk storage, etc.) for storing data and/or computer code for completing or facilitating the various processes, layers and modules described in the present application. The memory 224 may be or include volatile memory or non-volatile memory, and may include database components, object code components, script components, or any other type of information structure for supporting the various activities and information structures described in the present application. According to an exemplary embodiment, the memory 224 is communicably connected to the processor 222 via the processing circuit 220 and includes computer code for executing (e.g., by the processing circuit 220 and/or the processor 222) one or more processes described herein. In some embodiments, the memory 224 is configured to store/log various data associated with the actuation assembly 26, such as errors/service history, number of flushes, and the like.

Figure 18:
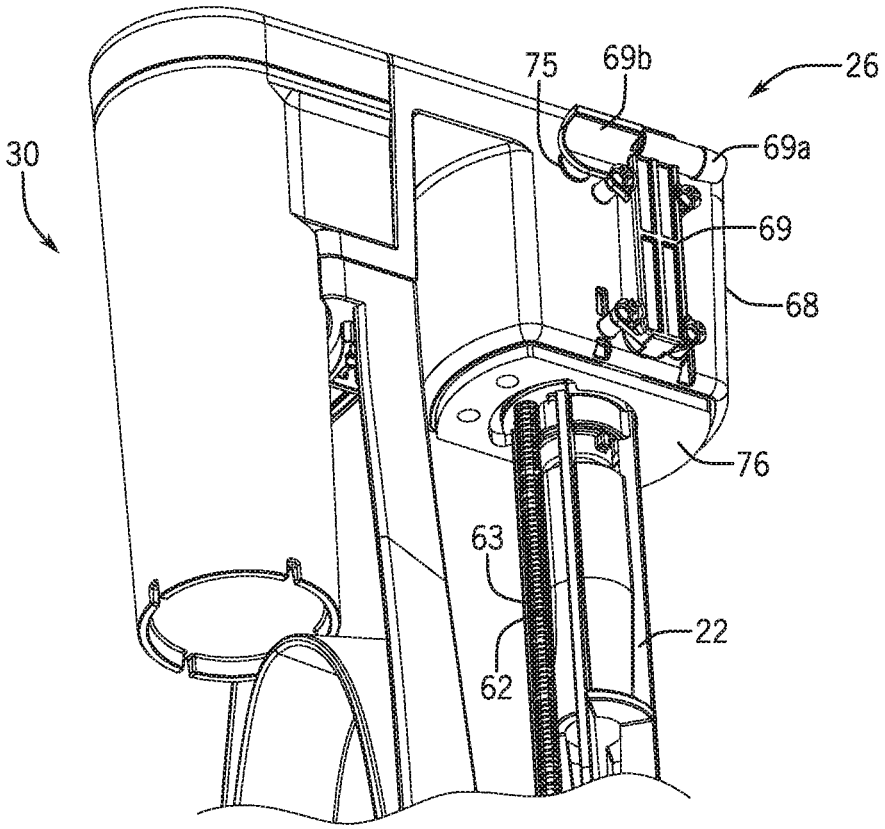
FIG. 18 is another partial perspective view of the flush valve assembly of FIG. 17.

Still referring to FIGS. 17-18, the actuator assembly 26 includes a refill pipe 69 coupled to an outer side portion of the housing 68. The refill pipe 69 includes a port 69*a* and a guide 69*b*. The refill pipe 69 is configured to be connected to the fill valve 29 at the port 69*a* via a flexible conduit. The housing 68 includes one or more openings positioned adjacent the refill pipe 69 for routing electrical wires therethrough, such as, for example, electrical wire 27 routed to the circuit board 83. A grommet 75 is coupled at the one or more openings to protect the electrical wires from damage. The guide 69*b* is configured to route electrical wires to/from the housing 68 through the grommet 75. For example, as shown in FIG. 17, the guide 69*b* extends above the canister 24 at the maximum height of the canister (i.e., when the canister 24 is lifted to a maximum height during a flushing cycle). The guide 69*b* has a curved shape that partially overlaps at least a portion of the canister 24, so as to route the electrical wires above the canister. In this way, the guide 69*b* can, advantageously, help to prevent interference between the electrical wires and the canister 24 during a flushing cycle.

Referring to FIGS. 18-24, the actuator assembly 26 further includes the actuator rod 62 and spring 63. A portion of the actuator rod 62 and spring 63 extend directly below the housing 68 through a bottom wall 68*a*. The actuator rod 62 is configured to translate upwardly in a longitudinal direction at least partially within the actuator assembly 26 in response to an electronic flush request (i.e., an input) received by the processing circuit 220. In this way, the actuator rod 62 can lift the arm 64 (i.e., when the actuator rod 62 is coupled to the arm 64, as explained below) to thereby lift the canister 24 away from the valve base 20 to perform a flushing function.

Figure 20:
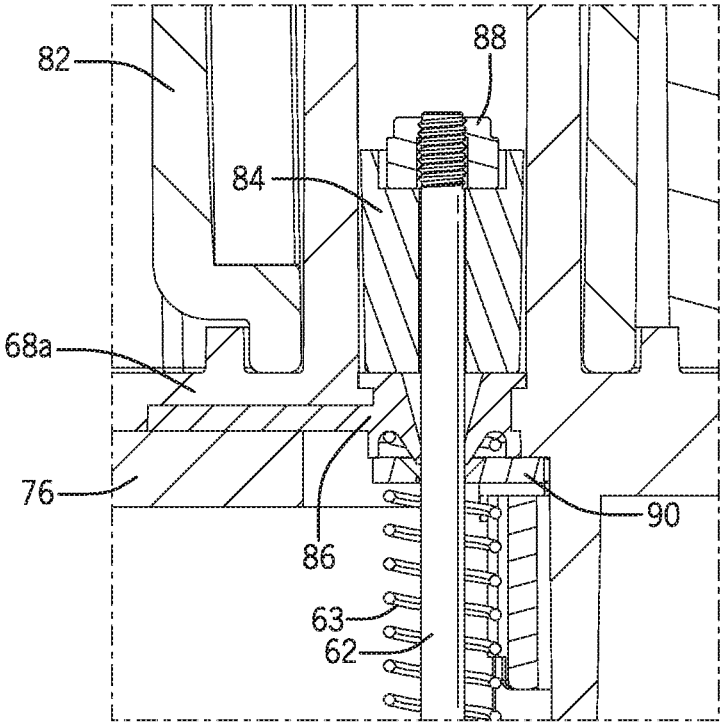
FIG. 20 is a detail view of an actuator of the flush valve assembly of FIG. 19.

For example, as shown in FIGS. 19-20, the actuator assembly 26 further includes a camshaft 82, a motor 78, and a gear 80 disposed within the housing 68. The gear 80 is coupled to, or integrally formed with, an output shaft of the motor 78, and is configured to be rotated by the motor 78 about an axis "K" defined by the output shaft. The camshaft 82 is rotatably coupled to a projection 68*b* extending from the bottom wall 68*a* of the housing 68. The gear 80 is in rotational engagement with a gear portion 82*b* of the camshaft 82 (e.g., via a plurality of splines or teeth). According to an exemplary embodiment, the gear 80 and the gear portion 82*b* have a 1:1 gear ratio, although other gear ratios are contemplated according to other exemplary embodiments. The gear 80 and the camshaft 82 are configured to rotate about separate parallel axes within the housing 68. The motor 78 is electrically coupled to the processing circuit 220, and is configured to be operated in response to an input, such as an electronic signal received from the processing circuit 220 (e.g., an electronic flush request received from the sensor 46, etc.). In response to the signal received from the processing circuit 220, the motor 78 can selectively rotate the gear 80, which in turn rotates the camshaft 82 about the projection 68*b* to thereby lift the actuator rod 62 in a longitudinal direction. In this manner, the actuator assembly 26 can, advantageously, conserve vertical space within the housing 68 due to the orientation/relative positions of the motor 78, the gear 80, and the camshaft 82.

As shown in FIGS. 19-24, a portion of the actuator rod 62 is disposed through a central portion of the camshaft 82 within an interior of the projection 68*b*. The projection 68*b* has a hollow cylindrical shape that defines a central axis "L" for rotation of the camshaft 82. The projection 68*b* includes a slot 68*c* extending vertically along a height of the projection 68*b*. A cam follower 84 is slidably disposed in the hollow interior of the projection 68*b* along the central axis L. The cam follower 84 is coupled to a proximal end of the actuator rod 62 via a fastener shown as a push nut 88, although the cam follower 84 may be coupled to the actuator rod 62 using other means, according to other exemplary embodiments. The cam follower 84 is configured to translate in a vertical direction along the central axis L relative to the projection 68*b* when the camshaft 82 is rotated, the details of which are discussed in the paragraphs that follow.

As shown in FIG. 20, the actuator rod 62 extends through the bottom wall 68*a* of the housing through an opening defined by a seal 86. The seal 86 can allow for movement of the actuator rod 62 relative to the seal, while preventing water from entering into the housing 68. A washer 90 is positioned below the seal 86 above the spring 63. The spring 63 is configured to be compressed against the washer 90 when the actuator rod 62 is translated upward in a vertical direction into the housing 68 during a flushing operation. In this manner, the washer 90 can help to prevent damage to the seal 86 from the spring 63.

Figure 21:
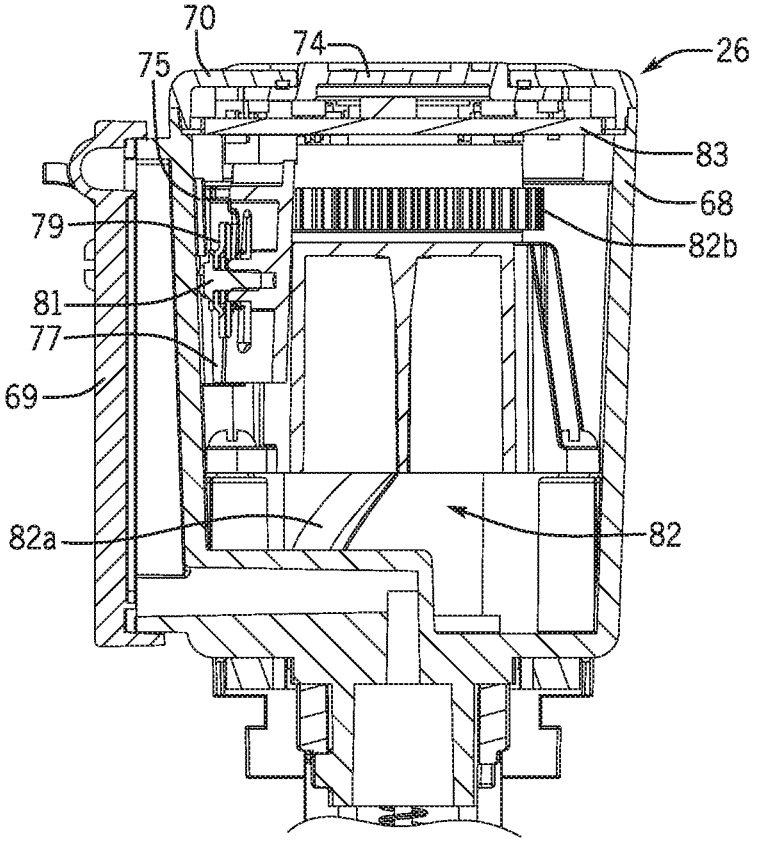
FIG. 21 is another partial cross-sectional view of the flush valve assembly of FIG. 17.
Figure 22:
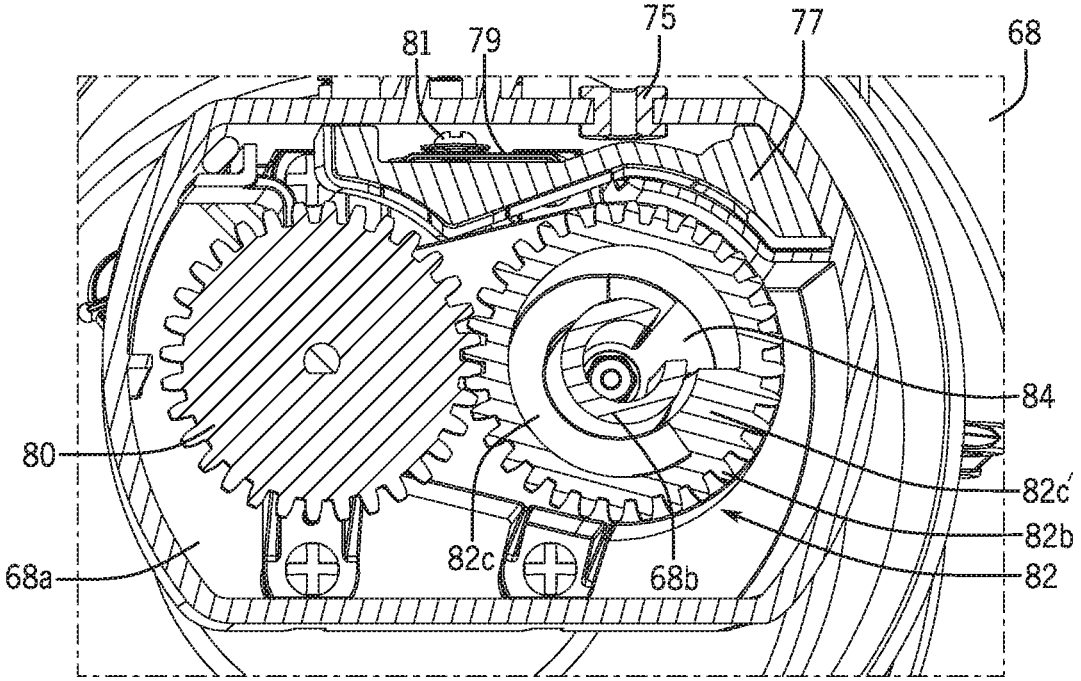
FIG. 22 is another partial cross-sectional view of the flush valve assembly of FIG. 17.

Referring to FIGS. 21-22, a guide member 77 is removably coupled within the housing 68. The guide member 77 is positioned adjacent the grommet 75, and is configured to direct one or more electrical wires that are routed into the housing 68 around the camshaft 82 and the motor 78 toward the circuit board 83. The guide member 77 includes a clamp 79 adjustably coupled to the guide member by a screw 81. One or more electrical wires may be disposed between the clamp 79 and a portion of the guide member 77, and the clamp may be adjusted relative to the guide member via the screw 81 to compress the wires against the guide member and maintain their relative position. In this manner, the guide member 77 can help to prevent interference between the electrical wires and the moving parts of the actuator assembly 26 (e.g., camshaft 82, motor 78, gear 80, etc.).

Figure 24:
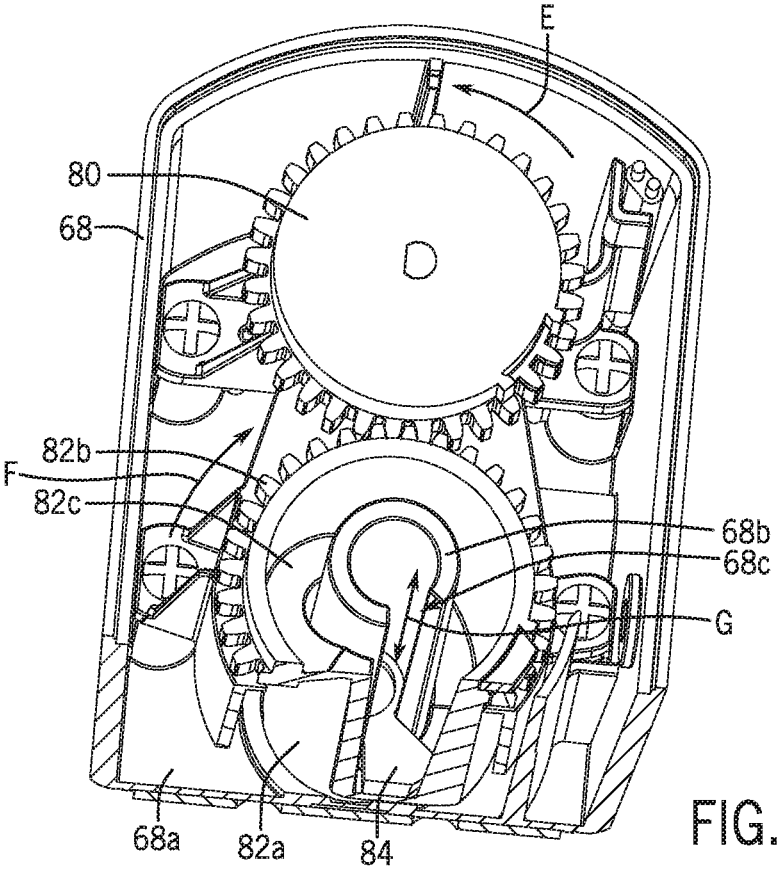
FIG. 24 is another partial cross-sectional view of the actuator assembly of the flush valve assembly of FIG. 17.
Figure 25:
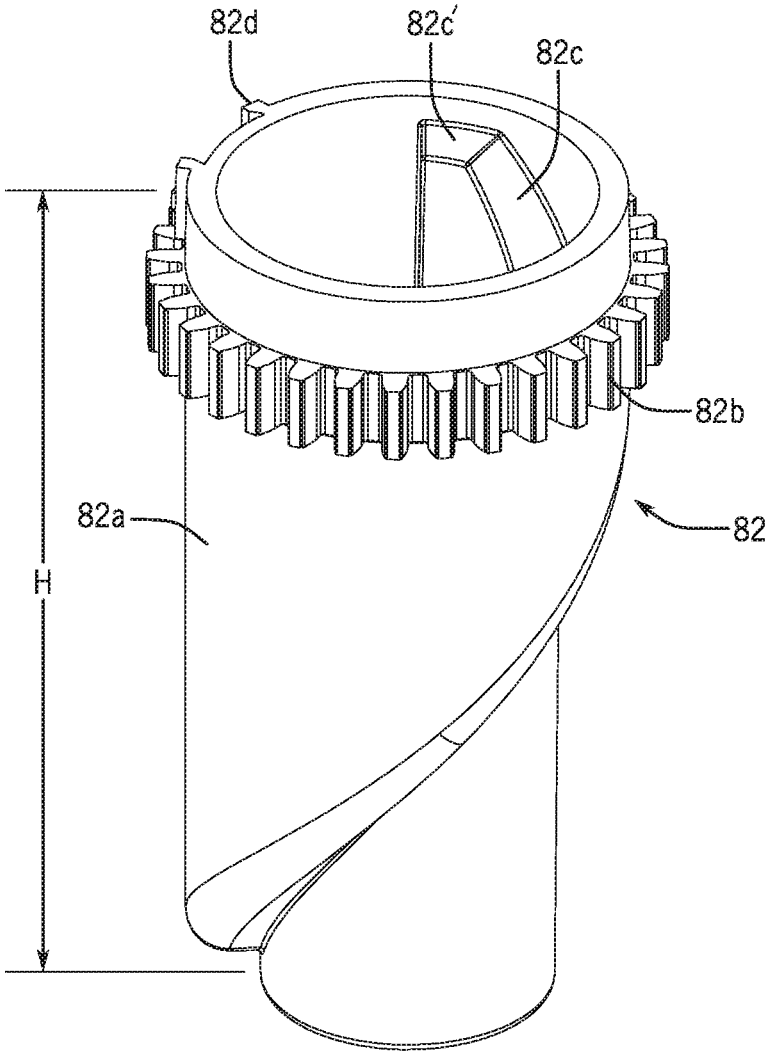
FIG. 25 is a perspective view of a cam shaft of the actuator assembly of FIG. 17.

Referring to FIGS. 19-24, a portion (e.g., a second portion) of the cam follower 84 extends radially outward through the slot 68*d* within an inner portion of the camshaft 82. The portion of the cam follower 84 that is disposed within the camshaft 82 (e.g., a first portion) is configured to slidably engage an inner surface 82*c* of the camshaft, and to translate upwardly in a vertical direction indicated generally by arrow "G" in FIG. 24 when the camshaft 82 is rotated about the central axis L. As shown in FIGS. 24-25, the inner surface 82*c* has a helical shape that extends from a bottom end of the camshaft to an upper end of the camshaft. The inner surface 82*c* has a constant slope and a throw of about 1⅝" (inches), according to an exemplary embodiment. The inner surface 82*c* terminates at a flat portion 82*c*' located at an upper end of the camshaft 82 to define an endpoint of vertical travel for the cam follower 84. The inner surface 82*c* is configured to act as a ramp or sweep surface for guiding the cam follower 84 upwardly in the vertical direction G as the camshaft 82 rotates in a direction indicated generally by arrow "F." The slot 68*d* of the projection 68 can, advantageously, prevent rotation of the cam follower 84 as the camshaft 82 is rotated relative to the cam follower. When the cam follower 84 reaches the flat portion 82*c*', the spring 63 can bias the cam follower 84 downward toward the bottom end of the camshaft 82 to begin a new flush cycle.

Referring to FIG. 25, the camshaft 82 is shown according to an exemplary embodiment. As shown, the camshaft 82 includes a body 82*a* having a generally cylindrical shape. The body 82*a* includes a hollow inner portion at least partially defined by the inner surface 82*c*. The inner surface 82*c* terminates at the flat portion 82*c*' located at a top end of the body 82*a*. The body 82*a* has a height "H" that corresponds, generally, to the total amount of vertical travel of the cam follower 84 to perform a flushing function (i.e., to lift the canister 24 away from the valve base 20). The body 82*a* includes a gear portion 82*b* defined by a plurality of teeth or splines that extend annularly around an upper portion of the body. The body 82*a* further includes an opening 82*d* disposed at an upper portion of the body near the end of travel of the cam follower 84. The opening 82*d* is configured to receive a magnetic member 81 therein. According to an exemplary embodiment, the magnetic member 81 is in electronic communication with a sensor 230 (e.g., hall-effect sensor, reed switch, optical sensor, etc.) coupled to the circuit board 83 and to the processing circuit 220. The sensor 230 can, advantageously, interact with the magnetic member 81, so as to track a rotational position of the camshaft 82. In this manner, the processing circuit 220 can determine whether a flush cycle has been completed based on the rotational position of the magnetic member 81 relative to the circuit board 83 (i.e., whether the camshaft 82 has completed a 360 degree rotation, etc.), so as to, for example, control the on/off operation of the motor 78.

Figure 26:
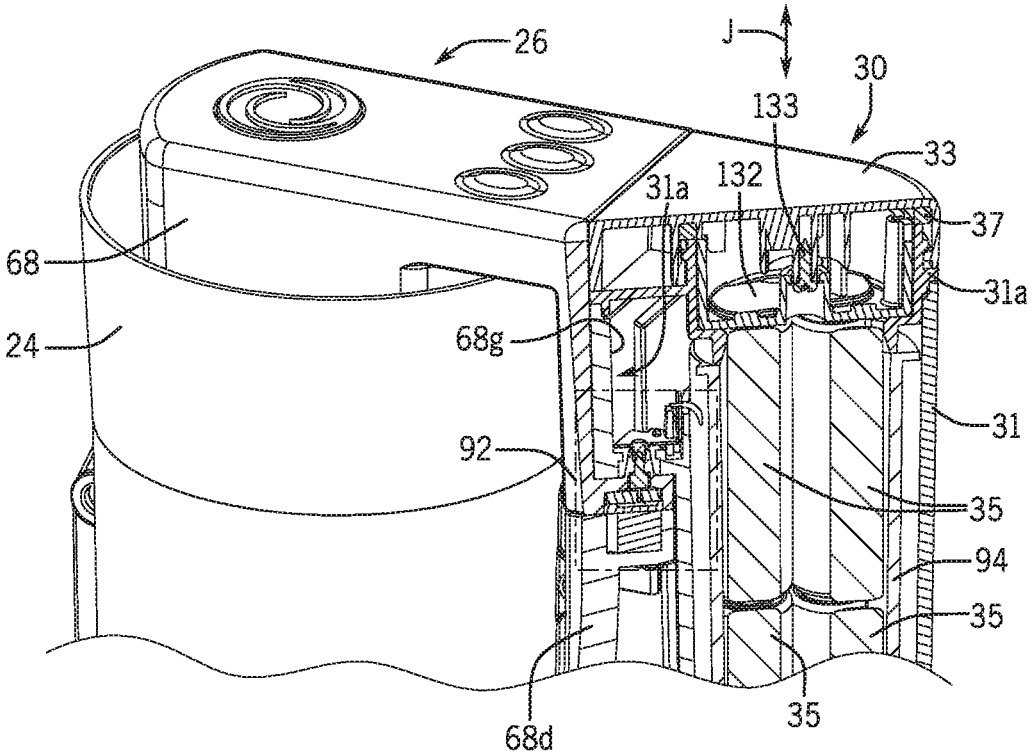
FIG. 26 is a partial cross-sectional view of the flush valve assembly of FIG. 17.
Figure 27:
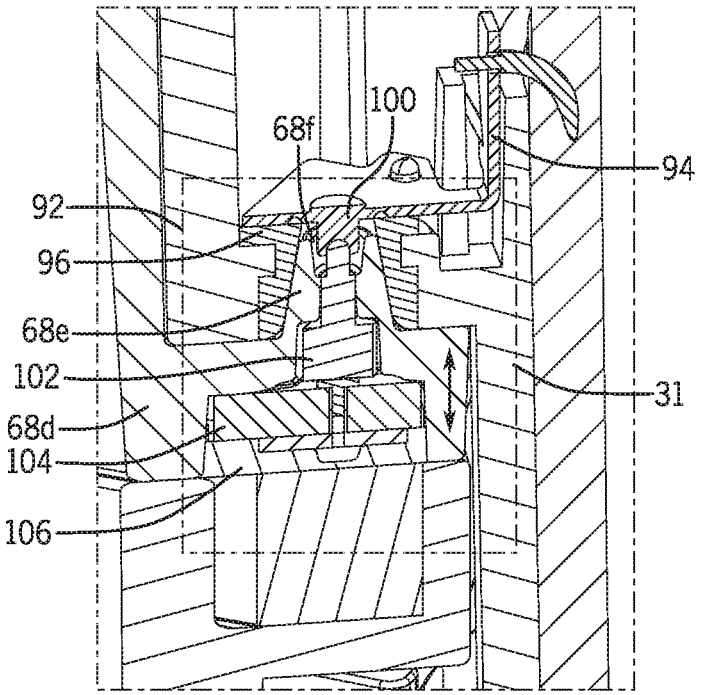
FIG. 27 is a detail view of the flush valve assembly of FIG. 26.

Referring to FIGS. 26-27, a power source 30 shown as a battery pack is electrically coupled to the actuator assembly 26 through a connector subassembly 92. According to an exemplary embodiment, the power source 30 is removably coupled to the housing 68 via a projection 68*g* and corresponding slot 31*a*. The power source 30 is configured to provide electrical power to the actuator assembly 26. As shown, the housing 68 includes a flange portion 68*d* extending outwardly therefrom for receiving the power source 30. The power source 30 includes a battery housing 31 and a plurality of battery cells 35 removably coupled therein (e.g., AA-size alkaline batteries, etc.). A guide 94 is disposed in the battery housing 31 and can help to align the plurality of battery cells 35 in an axial direction therein. A cover 33 is removably coupled to an upper portion of the battery housing 31 to allow access to the battery cells 35. The cover 33 includes a seal 37 for sealing off at least a portion of the battery housing 31 where the battery cells 35 are disposed. The battery housing 31 has a generally L shaped configuration, such that a portion of the battery housing 31 can rest on top of the flange portion 68*d* of the housing. The housing 68 further includes a projection 68*e* extending upwardly from the flange portion 68*d*. The projection 68*e* is configured to be received within a portion of the battery housing 31, so as to couple the power source 30 to the actuator assembly 26.

As shown in FIG. 27, the connector subassembly 92 is partially defined by a spring contact 102 (e.g., pogo pin connector, etc.) coupled to a circuit board 104. The circuit board 104 is coupled within a recess of the flange portion 68*d*, such that a portion of the spring contact 102 extends through an opening of the projection 68*e* disposed in a counterbore 68*f* of the projection. A cover 106 is coupled to the flange portion 68*d* below the circuit board 104 to retain the circuit board 104 and the spring contact 102 relative to the housing 68. A first contact 100 extends outwardly away from the guide 94, and is configured to be at least partially received within the counterbore 68*f* of the projection 68*e*, such that the first contact 100 engages the spring contact 102 to thereby compress a portion of the spring contact. An annular seal 96 is coupled to the battery housing 31 and surrounds an outer portion of the first contact 100. The annular seal 96 is configured to engage and surround an outer surface of the projection 68*e*, such that the interface between the first contact 100 and the spring contact 102 is substantially sealed off from contaminants, such as water, mold, or the like. In this manner, the connector subassembly 92 provides for an electrical connection between the battery pack 30 and the actuation assembly 26 that is robust enough to survive extended use in a toilet tank environment without the need for service or replacement. According to an exemplary embodiment, the battery pack 30 includes at least one connector subassembly 92 associated with an electrical contact of the battery pack. According to another exemplary embodiment, the battery pack 30 includes two connector subassemblies 92 associated with first and second electrical contacts, respectively, of the battery pack (e.g., positive and negative poles, etc.).

Figure 28:
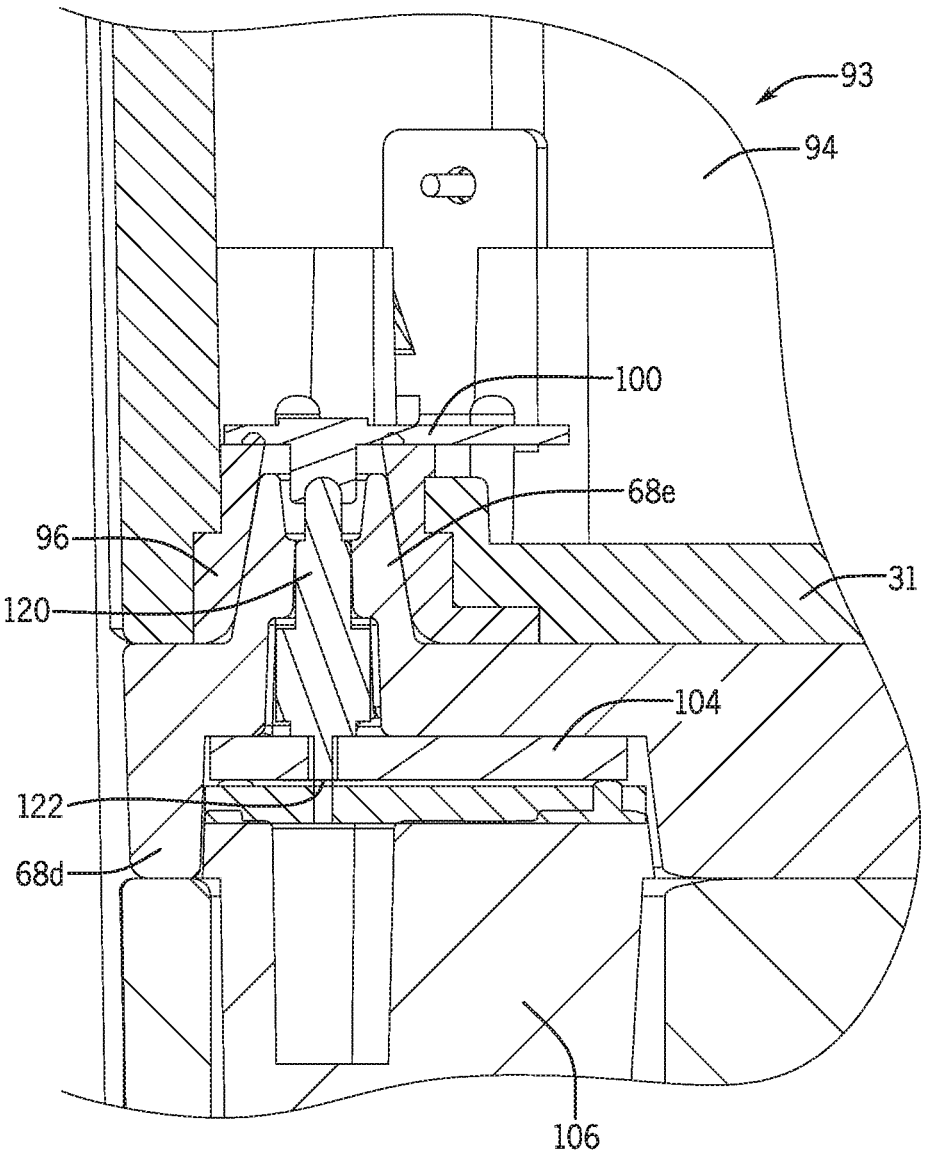
FIG. 28 is a detail view of a flush valve assembly according to another exemplary embodiment.

Referring to FIG. 28, a connector subassembly 93 is shown according to another exemplary embodiment. In this exemplary embodiment, a rigid pin 120 and a receptacle 122 are used instead of a spring contact 102, as in the embodiment of FIG. 27. As shown in the embodiment of FIG. 28, the rigid pin 120 is coupled to the first contact 100. The receptacle 122 is coupled to the circuit board 104 and extends into the projection 68*e*. The receptacle 122 is configured to receive the rigid pin 120 therein, so as to electrically couple the battery pack 30 to the actuation assembly 26.

Figure 29:
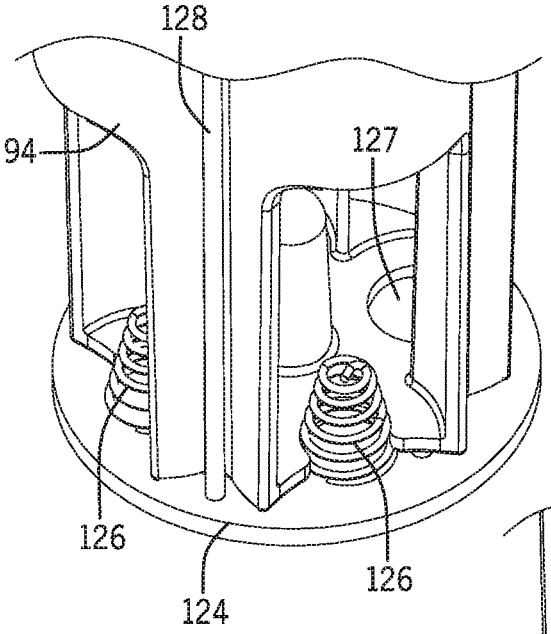
FIGS. 29-30 are partial perspective views of a lower portion of a battery pack for a flush valve assembly according to an exemplary embodiment.
Figure 30:
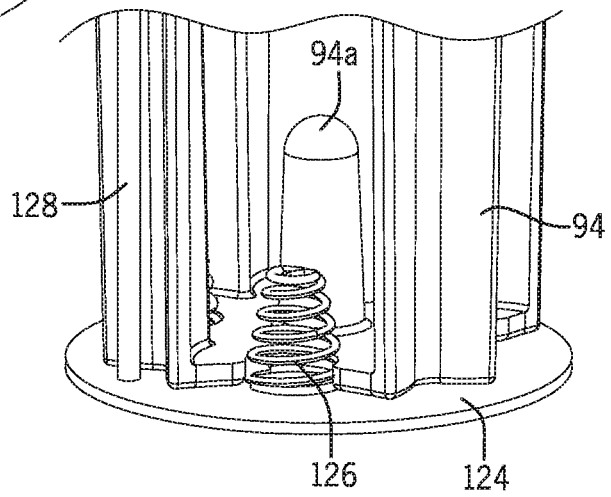

Referring to FIGS. 29-30, a lower portion of the battery pack 30 is shown according to an exemplary embodiment. The battery pack 30 is shown to include a circuit board 124 that can, advantageously, provide reverse voltage protection for the battery pack 30. The circuit board 124 is disposed at the lower portion of the battery pack 30, as shown in FIG. 26, and includes a plurality of contacts 126, 127 for engaging with the plurality of battery cells 35. The battery pack 30 further includes a projection 94*a* extending from a lower portion of the guide 94. The guide 94 defines a plurality of channels for receiving and retaining the plurality of battery cells 35 in the battery housing 31. The projection 94*a* is disposed at the center of the guide 94 and extends upwardly away from the circuit board 124, which can, advantageously, help to axially align and position the plurality of battery cells 35 within the battery pack 30.

Figure 31:
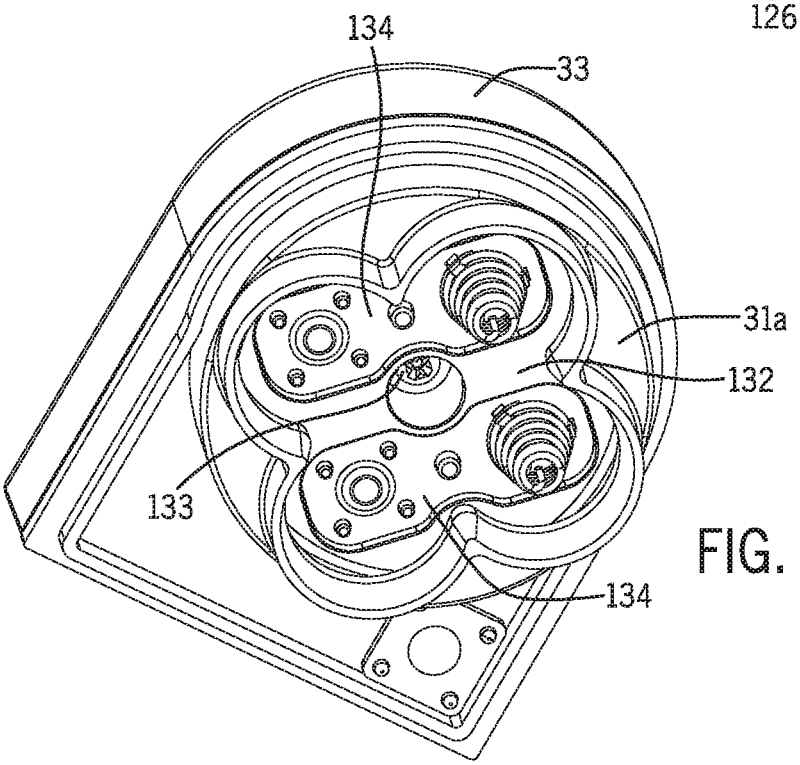
FIG. 31 is a partial perspective view of a battery pack cover according to an exemplary embodiment.
Figure 32:
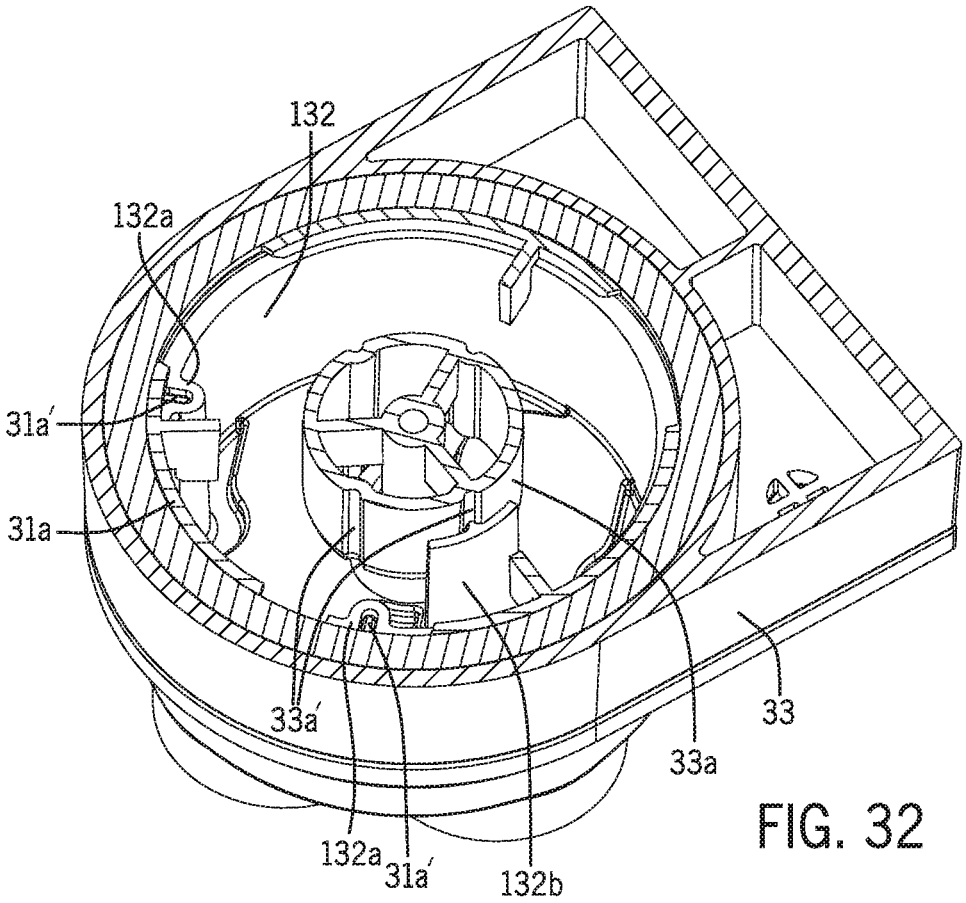
FIG. 32 is a partial cross-sectional view of the battery pack cover of FIG. 31.

Referring to FIGS. 31-32, the cover 33 of the battery pack 30 is shown according to an exemplary embodiment. A contact retainer 132 is coupled to the cover 33 by a fastener shown as a screw 133, although other fasteners or fastening arrangements may be used. The contact retainer 132 includes a plurality of bridge contacts 134 coupled thereto for engaging with a plurality of battery cells 35 disposed in an upper portion 31*a* of the battery housing 31. The contact retainer 132 includes one or more slots 132*a* for interfacing with complementary ribs 31*a*' extending from the upper portion 31*a* of the battery housing 31. The slots 132*a* can, advantageously, help to locate the cover 33 relative to the battery housing 31 during installation of the cover, and to prevent relative rotational movement between the body of the contact retainer 132 and the housing. The contact retainer 132 further includes an inner rib 132*b* for engaging with a detent interface 33*a* extending from the cover 33. The detent interface 33*a* is concentric with the center of rotation for the cover 33, and includes a portion for threadably receiving the screw 133 therein to couple the contact retainer 132 to the cover 33. The detent interface 33*a* further includes a plurality of longitudinal channels 33*a*' extending along a periphery of the interface for engaging with the inner rib 132*b* of the contact retainer, so as to help to rotationally align and couple the contact retainer 132 to the cover 33. The contact retainer 132 is permitted to move along a longitudinal direction relative to the cover 33 when the contact retainer 132 is engaged with the plurality of battery cells 35 in the housing. Thus, the detent interface 33*a* helps to maintain a rotational position of the contact retainer 132 relative to the cover 33 when the contact retainer 132 is moved relative to the cover 33, such as during removal of the cover 33 from the battery housing 31 and replacement of the battery cells 35. In this manner, the bridge contacts 134 will be properly oriented relative to the plurality of battery cells 35 when the cover 33 is removed from, and coupled to, the battery housing 31.

Figure 33:
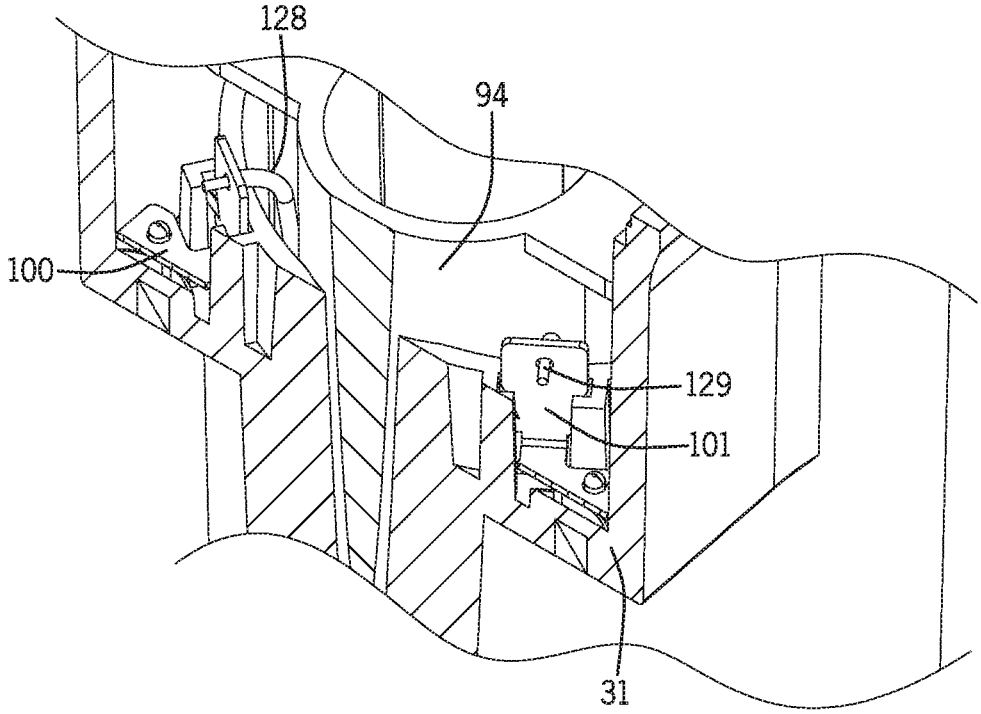
FIG. 33 is a partial perspective view of an electrical contact portion of a battery pack for a flush valve assembly according to an exemplary embodiment.

Referring to FIG. 33, a portion of the battery pack 30 including a plurality of connector contacts is shown according to an exemplary embodiment. As shown in FIG. 33, the first contact 100 is coupled to the housing 31 and defines part of a first connector subassembly for electrically coupling the battery pack 30 to the actuator assembly 26 (e.g., connector subassembly 92, 93, etc.). A second contact 101 is also coupled to the housing 31 and defines part of a second connector subassembly for electrically coupling the battery pack 30 to the actuator assembly 26 (e.g., connector subassembly 92, 93, etc.). A first electrical wire 128 extending from the reverse voltage protection circuit board 124 electrically couples a first plurality of the battery cells 35 to the first contact 100. A second electrical wire 129 extending from the reverse voltage protection circuit board 124 electrically couples a second plurality of the battery cells 35 to the second contact 101. The first and second electrical wires 128, 129 are routed adjacent the guide 94. In this manner, the first and second contacts 100, 101 can be used to electrically couple the battery pack 30 to the actuator assembly 26.

Figure 39:
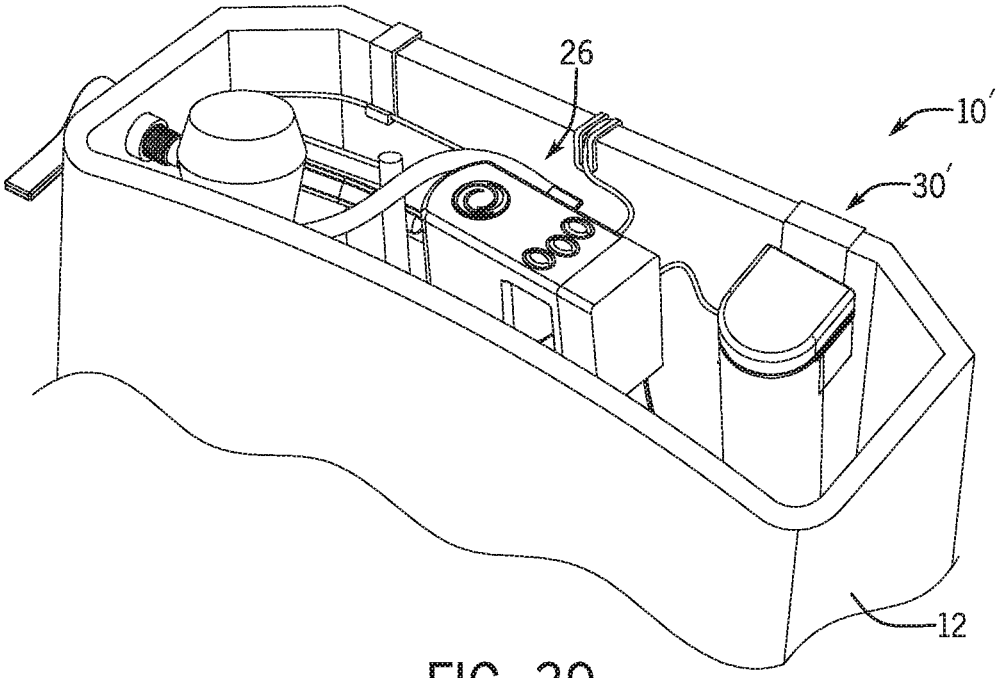
FIGS. 39-40 are partial perspective views of a toilet including a remote power source according to another exemplary embodiment.
Figure 40:
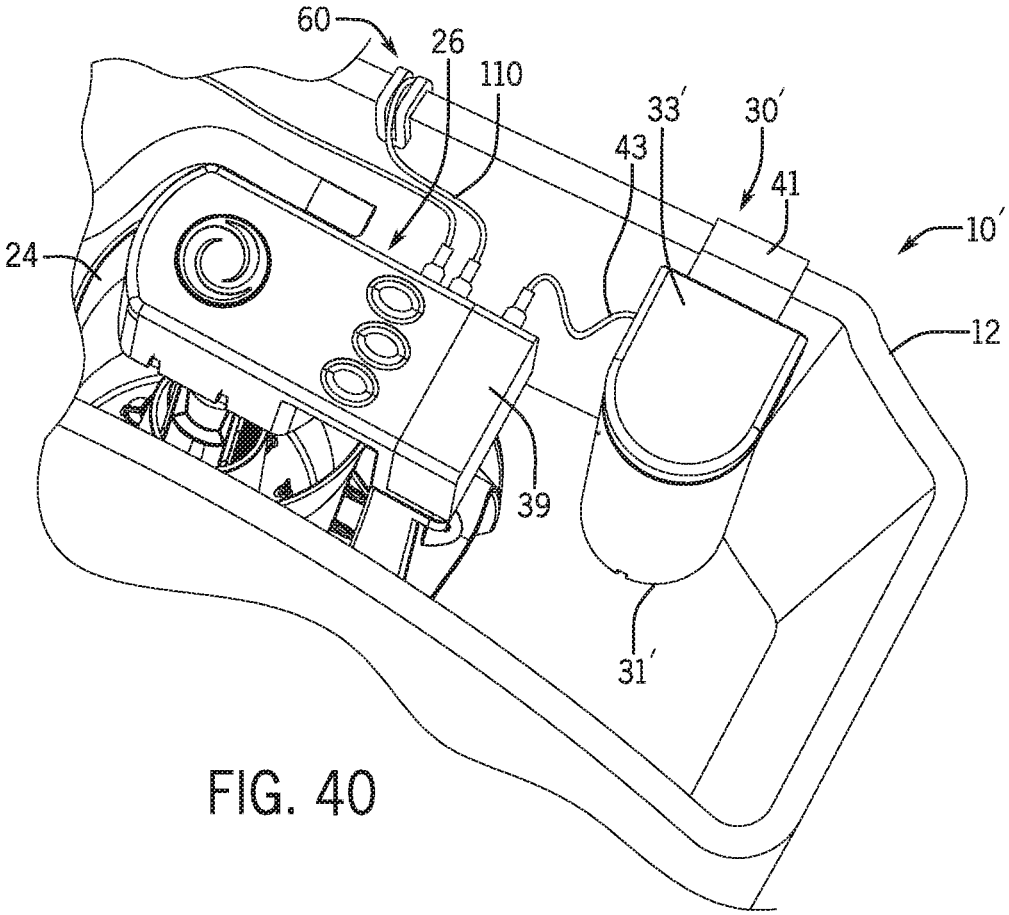

FIGS. 39-42 illustrate a power source 30' shown as a remote battery pack coupled within the tank 12 according to another exemplary embodiment. As shown in FIGS. 39-40, a toilet 10' includes the tank 12. The valve actuator assembly 26 is coupled within the tank 12. The power source 30' is removably coupled to the valve actuator assembly 26 by an adapter 39. The power source 30' further includes a battery housing 31' located remotely from the adapter 39. The battery housing 31' includes a cover 33' removably coupled to an upper portion of the battery housing, and one or more battery cells disposed therein (e.g., battery cells 35, etc.). The battery housing 31' including the one or more battery cells is electrically coupled to the adapter 39 by a flexible connector 43 shown as an electrical cord, according to an exemplary embodiment, although other flexible connectors may be used, according to other exemplary embodiments. The battery housing 31' includes a clip 41 for removably coupling the battery housing 31' at a remote location, such as along an inner wall of the tank 12. In this manner, the adapter 39 allows for remote/repositionable placement of the battery housing 31', such as for use in small tanks or when paired with other in-tank devices.

Figure 42:
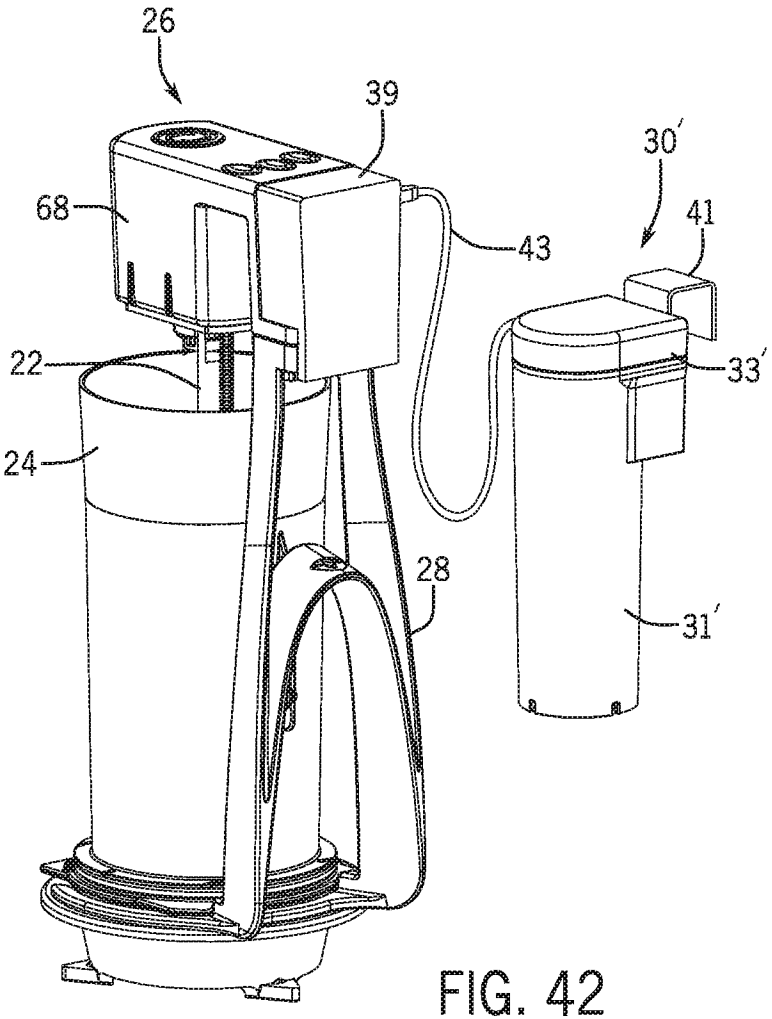
FIGS. 41-42 are perspective views of a valve assembly including the remote power source of FIGS. 39-40.
Figure 41:
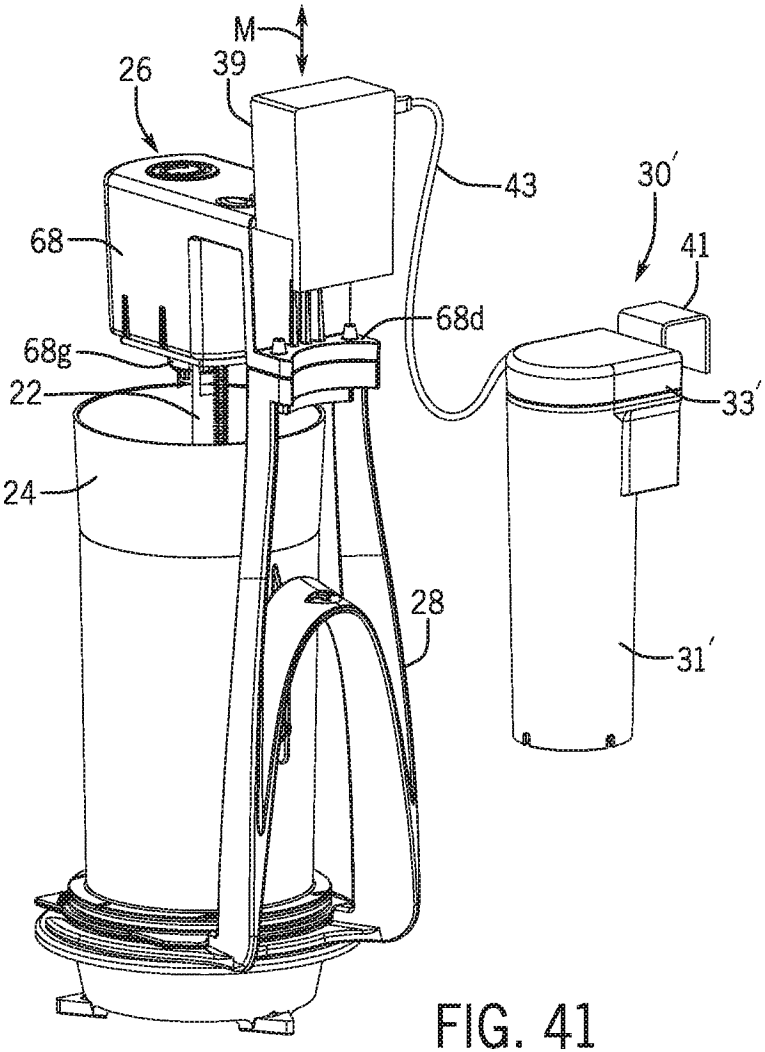

Still referring to FIGS. 39-42, the adapter 39 is configured to be slid into place on the housing 68 in a direction indicated generally by arrow "M" in FIG. 41 along the projection 68*g* of the housing, such that a portion of the adapter engages the flange portion 68*d* (i.e., in the same manner as power source 30). According to an exemplary embodiment, the adapter 39 and the flange portion 68*d* include the same connector subassembly (e.g., connector subassembly 92, 93, etc.) discussed above with respect to power source 30 to electrically couple the adapter to the actuator assembly 26. The flexible connector 43 is removably coupled to the adapter 39, such that the battery housing 31' including the battery cells can be electrically coupled to an external power source (e.g., an electrical outlet in a home, etc.) via the connector 43 to, for example, charge the battery cells. As shown in FIGS. 41-42, the clip 41 has a generally U-shaped configuration so as to, for example, allow for removably coupling the battery housing 31' along an upper edge of the tank 12. The clip 41 can overhang the top of the tank 12, and the tank lid can be placed over top of the clip without interfering with the battery housing 31'. In this way, the battery housing 31' including the battery cells can, advantageously, be selectively repositioned relative to the tank 12.

Figure 34:
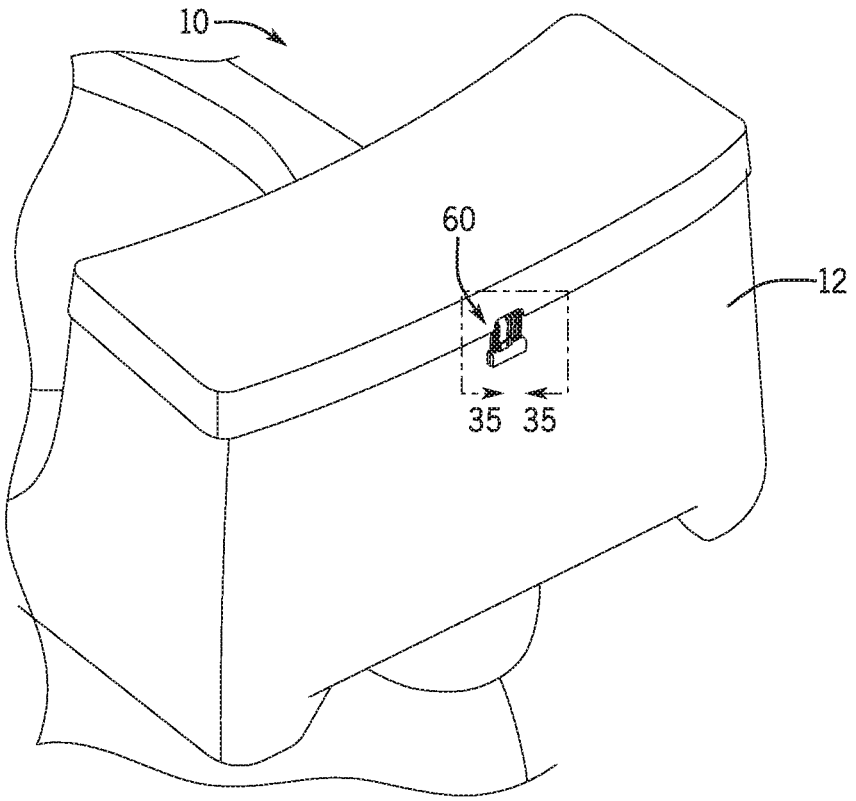
FIG. 34 is a partial perspective view of the toilet assembly of FIG. 1.
Figure 35:
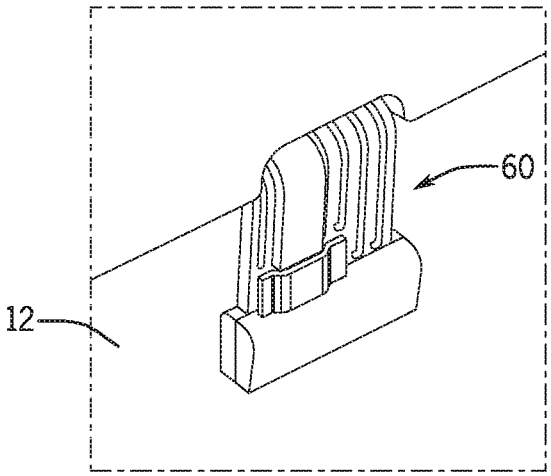
FIG. 35 is a detail view of a nightlight assembly of the toilet assembly of FIG. 34.
Figure 36:
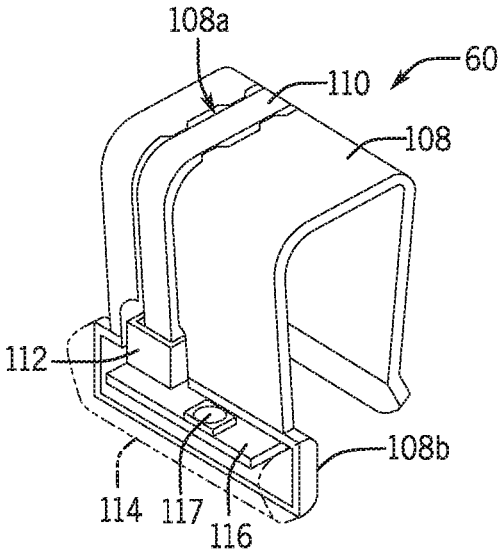
FIG. 36 is a perspective view of the nightlight assembly of FIG. 35.

Referring to FIGS. 34-36, the toilet 10 includes a nightlight 60 coupled to an upper rear portion of the tank 12. The nightlight 60 is in electronic communication with the processing circuit 220, and is configured to provide illumination above the tank 12 along an adjacent wall behind the toilet 10. The nightlight 60 has a configuration that allows for the nightlight 60 to be substantially concealed from view behind the tank 12. For example, as shown in FIGS. 35-36, the nightlight 60 includes a member 108 having a generally U-shaped configuration. The member 108 is configured to be coupled to an upper edge of a toilet tank, such as tank 12 (see FIG. 35). The member 108 includes a channel 108*a* for receiving an electrical wire 110 therein.

According to an exemplary embodiment, the electrical wire 110 is received from the actuator assembly 26. The channel 108*a* can, advantageously, help to prevent compression of the electrical wire 110 from the lid or cover of the tank 12. The member 108 further includes a housing 108*b* located at an end of the U-shaped member for receiving a circuit board 116 therein. The circuit board 116 includes one or more light sources 117 (e.g., LEDs, etc.) configured to emit light. The circuit board 116 is in electrical communication with the processing circuit 220 via the electrical wire 110 to control operation of the nightlight 60. The nightlight 60 further includes a lens 114 coupled to the housing 108*b*. The lens 114 is transmissive to allow the light emitted by the one or more light sources 117 to pass therethrough. A seal 112 is coupled at the interface between the cable 110 and the lens 114 to help prevent fluids or other contaminants from reaching the circuit board 116.

Figure 37:
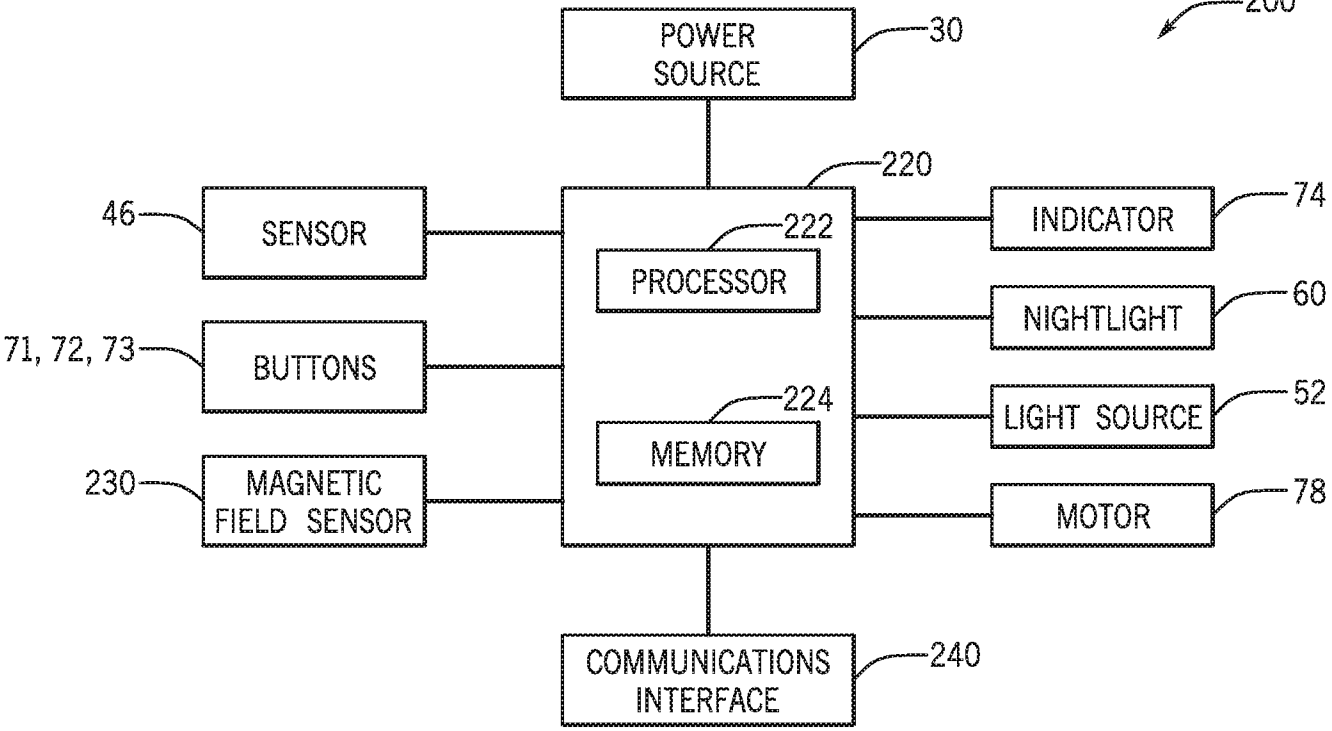
FIG. 37 is a schematic diagram of a touchless actuation system according to an exemplary embodiment.

Referring to FIG. 37, a block diagram of a touchless actuation system 200 of the toilet 10 is shown, according to an exemplary embodiment. System 200 is shown to include sensor 46, processing circuit 220 including processor 222 and memory 224, power supply 30, and motor 78. System 200 is further shown to include user interface buttons 71, 72, 73, indicator 74, nightlight 60, light source 52, sensor 230 (e.g., hall effect sensor, optical sensor, reed switch, mechanical switch, etc.), and a communications interface 240.

According to an exemplary embodiment, the communications interface 240 may include wired or wireless interfaces (e.g., jacks, antennas, transmitters, receivers, transceivers, wire terminals, etc.) for conducting data communications between system 200 and external sources. In an exemplary embodiment, communications interface 240 may be a Bluetooth radio. Communications interface 240 may be used as a supplemental trigger for actuating flushing in addition to the signal received via sensor 46. For example, a user may transmit a signal (e.g., via a mobile device, a remote control, a wired control panel, touch sensor, or any other input device) to communications interface 240. The transmitted signal may be interpreted by processing circuit 220 and used as a basis for activating motor 78 to perform a flushing function.

In some exemplary embodiments, communications interface 240 may also be used to control settings of nightlight 60 (e.g., color, intensity, lighting schedules, etc.), settings of sensor 46 (e.g., detection region thresholds, on/off functionality, etc.), perform diagnostics, apply firmware updates, and conduct user data collection (e.g., flushes per day, etc.). Communications interface 240 may further be used to send a warning signal (e.g., that the batteries of the power source 30, 30' need to be replaced or another error has occurred) to an external system.

In operation of touchless actuation system 200, sensor 46 may produce a signal indicating the distance of an object (e.g., a user's hand or forearm) within a detection region of the sensor and transmit the signal to processing circuit 220. Processing circuit 220 can determine whether the detected distance is less than or equal to a threshold distance within the detection region. If the detected distance is greater than the threshold distance, the processing circuit 220 may determine that the flush request was unintended and can disregard the request. In this way, the processing circuit 220 can filter out unintended flush requests. If, however, the detected distance is less than or equal to the threshold distance, the processing circuit 220 may respond by sending a signal to operate the motor 78. The motor 78 can then rotate the gear 80 about a direction indicated generally by arrow "E" in FIG. 24. Rotation of the gear 80 will cause rotation of the camshaft 82 in the direction F shown in FIG. 24. Rotation of the camshaft 82 in the direction F will cause the cam follower 84 to translate upwardly in a longitudinal direction G along the inner surface 82*c*. As the cam follower 84 translates upwardly in a longitudinal direction, the actuator rod 62 is also translated in the same direction along the central axis L within the projection 68*b*, thereby lifting the arm 64 and the canister 24 away from the valve base 20 to perform a flushing function. The spring 63 is simultaneously compressed against the washer 90 as the actuator rod 62 is moved upwardly into the projection 68*b*. When the cam follower 84 reaches the end of the flat portion 82*c*' of the camshaft 82, the spring 63 can bias the cam follower 84 back to the bottom end of the camshaft 82 toward the bottom wall 68*a* of the housing. The actuator rod 62 and arm 64 are also biased downward until the canister 24 reengages the valve base 20 to begin a new flush cycle.

Figure 38:
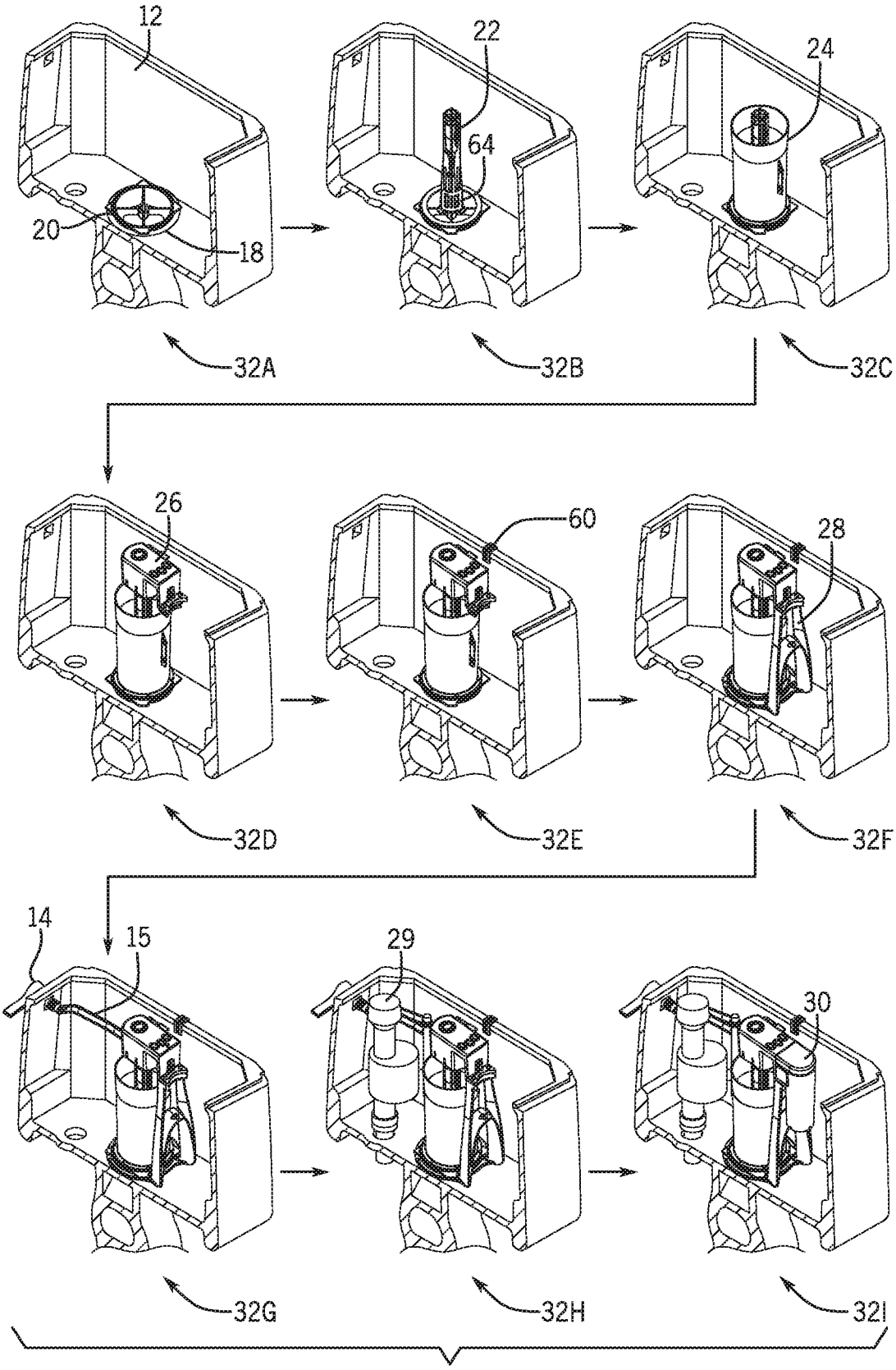
FIG. 38 is a flow diagram illustrating a method of installing a flush valve assembly in a tank of the toilet of FIG. 1.

Referring to FIG. 38, a flow diagram illustrating a method of installing a flush valve assembly is shown according to an exemplary embodiment. In a first step 32A, the valve base 20 and seal 18 are coupled in the tank 12 at a water outlet of the tank. In a second step 32B, the valve guide 22 including the arm 64 is coupled to the valve base 20. In a third step 32C, the canister 24 is disposed over the valve guide 22 and is engaged with the valve base 20. In a fourth step 32D, the actuator assembly 26 is lowered over top of the canister 24 such that the second magnetic member 65 on the actuator rod 62 automatically couples to the first magnetic member 66 on the arm 64 (i.e., via a magnetic coupling force). In this manner, the actuator assembly 26 can be easily coupled to the arm 64 directly above the canister 24 in a "blind" arrangement without having to manually reach between the canister 24 and the valve guide 22. The actuator assembly 26 is simultaneously twist-and-locked into an upper portion of the valve guide 22.

Still referring to FIG. 38, in a fifth step 32E, the nightlight 60 is coupled to an upper edge of the tank 12, and an electrical wire 110 from the actuator assembly 26 is coupled to the nightlight 60. In a sixth step 32F, support legs 28 are first coupled between two flanges on the valve base 20 and then coupled to the actuator assembly 26. In a seventh step 32G, the trip lever assembly 14 is coupled to the tank 12. A plurality of clips (e.g., clips 31, etc.) are coupled along an upper peripheral edge of the tank 12, and the electrical wire 27 from the trip lever assembly 14 is removably coupled to the plurality of clips within the tank. The electrical wire 27 is then electrically coupled to a cable connector of the actuator assembly 26. In an eighth step 32H, the fill valve 29 is coupled in the tank 12. Lastly, in a ninth step 32I, the battery pack 30 is coupled to the actuator assembly 26.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the application as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the apparatus and control system as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments.

Other substitutions, modifications, changes and omissions may also be made in the design, operating conditions and arrangement of the various exemplary embodiments without departing from the scope of the present application. For example, any element disclosed in one embodiment may be incorporated or utilized with any other embodiment disclosed herein.

What is claimed is:

1. A trip lever assembly for a toilet, the trip lever assembly comprising:

a body configured to be mechanically coupled to a flush valve assembly of the toilet and rotated about a body rotation axis;

an infrared sensor coupled to the body in alignment with the body rotation axis and coaxial with the body rotation axis, wherein the infrared sensor is configured to be electrically coupled to the flush valve assembly;

wherein the body is configured to be manually actuated to control the flush valve assembly; and wherein the infrared sensor is a time-of-flight sensor configured to detect the distance of an object in a detection region of the infrared sensor to control the flush valve assembly.

2. The trip lever assembly of claim 1, further comprising a lens coupled to the body in front of the infrared sensor.

3. The trip lever assembly of claim 2, wherein the lens defines an outer facing surface of the body, and wherein the outer facing surface is flush with a surrounding portion of the body.

4. The trip lever assembly of claim 2, wherein the lens includes a infrared transmissive portion.

5. The trip lever assembly of claim 2, wherein the lens includes a localized region having a uniform thickness, and wherein the infrared sensor is disposed directly behind the localized region.

6. The trip lever assembly of claim 1, further comprising a light source configured to illuminate a rear portion of the trip lever assembly.

7. The trip lever assembly of claim 1, further comprising a bushing configured to be coupled to the toilet, wherein the body comprises a stem extending through the bushing, and wherein the stem defines the body rotation axis.

8. The trip lever assembly of claim 7, further comprising a nut configured to couple the bushing to the toilet.

9. The trip lever assembly of claim 7, wherein the bushing includes a slot configured to receive at least a portion of an electrical wire extending from the body through a portion of the toilet.

10. A trip lever assembly for a toilet, the trip lever assembly comprising:

a body configured to be mechanically coupled to a flush valve assembly of the toilet and rotated about a body rotation axis;

an infrared sensor coupled to the body and extended across a front face of the body in alignment with the body rotation axis and coaxial with the body rotation axis, wherein the infrared sensor is configured to be electrically coupled to the flush valve assembly;

wherein the body is configured to be manually actuated to pivot in a pivot plane to control the flush valve assembly, wherein the pivot plane is parallel to the front face of the body; and wherein the infrared sensor is a time-of-flight sensor configured to detect the distance of an object in a detection region of the infrared sensor to control the flush valve assembly.

11. The trip lever assembly of claim 10, further comprising a lens coupled to the body in front of the infrared sensor.

12. The trip lever assembly of claim 11, wherein the lens defines an outer facing surface of the body, and wherein the outer facing surface is flush with a surrounding portion of the body.

13. The trip lever assembly of claim 11, wherein the lens includes an infrared transmissive portion.

14. The trip lever assembly of claim 11, wherein the lens includes a localized region having a uniform thickness, and wherein the infrared sensor is disposed directly behind the localized region.

15. The trip lever assembly of claim 10, further comprising a light source configured to illuminate a rear portion of the trip lever assembly.

16. The trip lever assembly of claim 10, further comprising a bushing configured to be coupled to the toilet, wherein the body comprises a stem extending through the bushing, and wherein the stem defines the body rotation axis.

17. The trip lever assembly of claim 16, further comprising a nut configured to couple the bushing to the toilet.

18. The trip lever assembly of claim 16, wherein the bushing includes a slot configured to receive at least a portion of an electrical wire extending from the body through a portion of the toilet.

19. A trip lever assembly for a toilet, the trip lever assembly comprising:

a body configured to be mechanically coupled to a flush valve assembly of the toilet and rotated about a rotation axis;

a touchless sensor coupled to the body in alignment and coaxial with the rotation axis of the body, wherein the touchless sensor is configured to be electrically coupled to the flush valve assembly;

wherein the body is configured to be manually actuated to control the flush valve assembly; and wherein the touchless sensor is a time-of-flight sensor configured to detect the distance of an object in a detection region of the touchless sensor to control the flush valve assembly.

20. A trip lever assembly for a toilet, the trip lever assembly comprising:

a body configured to be mechanically coupled to a flush valve assembly of the toilet and rotated about a body rotation axis;

an infrared sensor coupled to the body, in alignment with the body rotation axis and coaxial with the body rotation axis, wherein the infrared sensor is configured to be electrically coupled to the flush valve assembly;

wherein the body is configured to be manually actuated to control the flush valve assembly; and wherein the infrared sensor is configured to detect an object in a detection region of the infrared sensor to control the flush valve assembly.

* * * * *